US010858136B2

(12) United States Patent
Wilkes et al.

(10) Patent No.: US 10,858,136 B2
(45) Date of Patent: Dec. 8, 2020

(54) FLEXIBLE CONTAINER AND PROCESS FOR INSTALLATION OF FITMENT IN SAME

(71) Applicant: Smart Bottle, Inc., Asheville, NC (US)

(72) Inventors: Kenneth R. Wilkes, Asheville, NC (US); Miguel Avalos, Mars Hill, NC (US); Ryan French, Candler, NC (US); John Kiffmeyer, Asheville, NC (US)

(73) Assignee: Smart Bottle, Inc., Asheville, NC (US)

( * ) Notice: Subject to any disclaimer, the term of this patent is extended or adjusted under 35 U.S.C. 154(b) by 0 days.

(21) Appl. No.: 16/673,736

(22) Filed: Nov. 4, 2019

(65) Prior Publication Data

US 2020/0339297 A1 Oct. 29, 2020

Related U.S. Application Data

(60) Provisional application No. 62/837,670, filed on Apr. 23, 2019.

(51) Int. Cl.
*B65B 61/00* (2006.01)
*B65B 61/18* (2006.01)
(Continued)

(52) U.S. Cl.
CPC ..... *B65B 61/186* (2013.01); *B65B 1/04* (2013.01); *B65B 43/123* (2013.01);
(Continued)

(58) Field of Classification Search
CPC .. B65B 1/04; B65B 3/04; B65B 43/04; B65B 43/123; B65B 43/267; B31B 70/84;
(Continued)

(56) References Cited

U.S. PATENT DOCUMENTS 4,012,972 A * 3/1977 Rice ..... B23D 21/14 82/70.2
5,378,065 A 1/1995 Tobolka
(Continued)

FOREIGN PATENT DOCUMENTS

EP 0893358 1/1999
GB 2406847 4/2005
(Continued)

OTHER PUBLICATIONS

PX Sealer PacXpert, published by ModenaPak on May 22, 2017, retrieved from URL https://www.youtube.com/watch?v=yiTldx_vBRQ&list=PLSuk6sW-T1xKu8SXGsGpD1N7SH5NYIflx&index=20&t=0s on Mar. 10, 2020 (Year: 2017).*
(Continued)

*Primary Examiner* — Hemant Desai
*Assistant Examiner* — Valentin Neacsu
(74) *Attorney, Agent, or Firm* — Clark Hill PLC; Adam J. Fromm

(57) ABSTRACT

A flexible container formed of flexible web material is provided. The container includes four panels forming: a body portion; a neck portion; a flare portion extending from the neck portion; and a tapered transition portion between the body and neck portions; wherein the neck portion has a reduced width and the flare portion has an expanded end. Also disclosed is a method of forming the aforementioned container comprising steps of: biasing the expanded end to define a circumference; moving, via a mandrel comprising a groove, the fitment within the circumference and through the expanded end to a first position in the neck; transversely cutting away the expanded end by advancing preferably v-shaped blades through the neck and into the groove preferably without rotation of the mandrel, container, or
(Continued)

blades; moving the fitment to a second position in the neck; and sealing the neck to the fitment.

18 Claims, 17 Drawing Sheets

(51) Int. Cl.
*B65D 75/58* (2006.01)
*B65B 43/12* (2006.01)
*B65B 43/26* (2006.01)
*B65B 1/04* (2006.01)
*B65B 61/06* (2006.01)

(52) U.S. Cl.
CPC ..... *B65B 43/267* (2013.01); *B65B 61/005* (2013.01); *B65B 61/06* (2013.01); *B65D 75/5883* (2013.01)

(58) Field of Classification Search
CPC ..... B31B 70/844; B31B 70/85; B31B 70/853; B31B 70/855; B31B 70/857; B31B 70/859; B23D 21/14
USPC ..... 53/459, 469, 570, 284.7; 493/87, 212, 493/213; 83/192–194
See application file for complete search history.

(56) References Cited

U.S. PATENT DOCUMENTS 5,783,638 A 7/1998 Lai et al.
5,855,544 A 1/1999 Buchanan
5,952,066 A 9/1999 Schmidt et al.
6,126,315 A 10/2000 Ichikawa et al.
7,117,777 B1 * 10/2006 Wilkes ..... B21D 43/028 83/320
7,147,597 B2 * 12/2006 Wilkes ..... B29C 65/02 493/212
7,335,148 B2 * 2/2008 Tsutsui ..... B31B 50/00 493/210
7,407,326 B2 * 8/2008 Wilkes ..... B65D 31/16 383/120
7,802,504 B1 * 9/2010 Wilkes ..... B26D 1/065 83/257
7,950,850 B2 5/2011 Fukuizumi
8,231,029 B2 * 7/2012 Peer ..... B65D 75/5883 220/754
8,348,509 B2 * 1/2013 Wilkes ..... B65D 35/02 383/10
8,621,745 B2 * 1/2014 Deonarine ..... B65C 9/0065 29/775
8,840,305 B2 * 9/2014 Wilkes ..... B65D 35/02 383/10
9,908,668 B2 * 3/2018 Wilkes ..... B65D 47/06
10,099,817 B2 * 10/2018 Wilkes ..... B29C 66/81427
2003/0202719 A1 * 10/2003 Wilkes ..... B29C 65/18 383/120
2004/0173073 A1 * 9/2004 Wilkes ..... B26D 5/32 83/371
2004/0254560 A1 12/2004 Coelho et al.
2005/0026761 A1 * 2/2005 Wilkes ..... B29C 65/02 493/87
2005/0123222 A1 * 6/2005 Wilkes ..... B65D 31/16 383/120
2006/0189466 A1 * 8/2006 Tsutsui ..... B31B 50/00 493/206
2006/0199716 A1 9/2006 Nakamoto et al.
2006/0285775 A1 12/2006 Fukuizumi
2007/0110344 A1 5/2007 Murray
2010/0163164 A1 * 7/2010 Deonarine ..... B65B 21/247 156/229
2011/0056965 A1 * 3/2011 Peer ..... B65D 75/5883 220/661
2011/0069908 A1 * 3/2011 Wilkes ..... B65D 35/02 383/10
2013/0121622 A1 * 5/2013 Wilkes ..... B65D 35/02 383/10
2015/0314919 A1 * 11/2015 Wilkes ..... B29C 65/18 156/308.2
2015/0314928 A1 * 11/2015 Wilkes ..... B65D 75/5883 222/566
2016/0016679 A1 * 1/2016 Pereira ..... B29C 66/81423 53/469
2016/0176567 A1 * 6/2016 Wilkes ..... B65D 75/5883 215/44
2018/0071991 A1 * 3/2018 Wilkes ..... B29C 66/723
2018/0079573 A1 * 3/2018 Wilkes ..... B65D 75/28
2018/0244418 A1 * 8/2018 Wilkes ..... B65B 61/186

FOREIGN PATENT DOCUMENTS

WO 2004101374 11/2004
WO 2017009701 1/2017

OTHER PUBLICATIONS

Smart Bottle Kiffnneyer Device Demo, published by SmartBottle Inc on Sep. 15, 2017, retrieved from URL https://www.youtube.com/watch?v=1SgwlrhNg1M&list=PLSuk6sW-T1xKu8SXGsGpD1N7SH5NYlflx&index=7 on Mar. 10, 2020 (Year: 2017).*
Smart Bottle Machine 2012, published by Ken Wilkes on Feb. 1, 2012, retrieved from URL https://www.youtube.com/watch?v=EHhHopEg3Wc&list=PLSuk6sW-T1xKu8SXGsGpD1N7SH5NYlflx&index=6 on Mar. 10, 2020 (Year: 2012).*
Smart Bottle Machine 2, published by Fred Schuldt on Jan. 20, 2012, retrieved from URL https://www.youtube.com/watch?v=k43wHzWEhDU&t=17s on Mar. 10, 2020 (Year: 2012).*
Definition of "CLAMP", Merriam-Webster online dictionary, retrieved from URL https://www.merriam-webster.com/dictionary/clamp on Mar. 11, 2020 (Year: 2020).*
International Search Report and Written Opinion for PCT/US2019/059407 dated Jan. 23, 2020.

* cited by examiner

FLEXIBLE CONTAINER AND PROCESS FOR INSTALLATION OF FITMENT IN SAME

CROSS REFERENCE TO RELATED APPLICATIONS

This application claims the benefit of U.S. Provisional Patent Application No. 62/837,670 filed in the United States Patent and Trademark Office on Apr. 23, 2019.

FIELD OF THE INVENTION

This invention relates to flexible containers having a fitment installed therein for dispensing a flowable material. More specifically, this invention relates to a container preferably formed from a flexible web material and having a preferably rigid fitment sealed in the neck of the flexible container, as well as methods for making the same.

BACKGROUND

This invention relates to flexible containers having a fitment. More specifically, this invention relates to devices and methods for installation of a rigid fitment into the neck of a bottle formed from a flexible web material.

Flexible containers with a gusseted body section are known. These gusseted flexible containers are currently produced using flexible films which are folded to form gussets and heat sealed into a perimeter shape. The gusseted body section opens to form a flexible container with a square cross section or a rectangular cross section. The gussets are terminated at the bottom of the container to form a substantially flat base, providing stability when the container is partially or wholly filled. The gussets are also terminated at the top of the container to form an open neck for receiving a rigid fitment and closure.

Conventional procedures for fabricating gusseted flexible containers with a rigid fitment have shortcomings. One conventional approach only partially heat seals the flexible container—requiring the bottom of the container to remain unsealed or otherwise open. The rigid fitment is subsequently inserted through the open bottom of the container and into the neck. Once the fitment is placed into the neck, the heat seal process continues, with a heat seal formed to close the previously-open container bottom. This approach is inefficient as it interrupts the perimeter heat seal procedure and requires two steps to form the container.

Another conventional approach requires the rigid fitment to be manually installed, upside down, into the neck opening. The fitment is then rotated by hand inside of the flexible container and pushed into place, aligning the fitment with the neck opening to allow proper sealing between the flexible container film structure and the fitment. The fitment is subsequently clamp heat sealed to the neck. This approach is cumbersome, labor intensive and time consuming.

Yet another conventional approach comprises the formation of a flexible container having a flared neck portion, somewhat shaped like a funnel, that diminishes in width as it extends toward the body of the container. A fitment is manually inserted in the flared neck portion toward the body and to a final position in the neck, wherein the neck is then contacted with a score device and the neck or the score device or both are rotated to cut excess flare portion from the neck. Problems with this approach are several fold. These problems include that the rotation of the neck and/or scoring device is an unnecessary complexity of the process for installation of the fitments that increases the cost and diminishes the reliability of the cutting step. Also, the gusseted and folded nature of the flared neck, including a plurality of flaps comprising multilayered sealed film material that may be stiff due to the thickness of the material, is not conducive to a suitable trimming of the neck portion by a rotating scoring device. Such uneven trimming can have a direct and deleterious effect on the reliability of the fitment seal in the neck at the uneven portions, including leaking of flowable contents from the container at the fitment seal or catastrophic failure of the container at the fitment seal in the event of an impact. Additionally, the rotational cutting is performed using the scoring device directly against the surface of the fitment, which can damage the integrity of the fitment itself.

A need in the art exists for a process of producing a gusseted flexible container which increases production efficiencies such as shortened production time, reduction of manual tasks via automation, and a streamlining of production steps.

SUMMARY

In order to resolve the aforementioned problems of the prior art and meet the aforementioned unmet need in art, the present disclosure provides a process for producing a flexible container and the resultant flexible container.

A preferred embodiment of the present invention comprises:

a method for forming a flexible container, the method comprising the steps of:

(a) providing a collapsed flexible container formed from a flexible web material and comprising four panels, the panels comprising:
  (i) a body portion;
  (ii) a neck portion that extends from the body portion;
  (iii) a flare portion that extends from the neck portion;
  (iv) a tapered transition portion extending between the body portion and the neck portion;
  (v) a handle portion that extends from the body portion, the handle portion and the neck portion defining a handle opening therebetween; and
  (vi) wherein the neck portion has a reduced width, the flare portion has an expanded end, and the width of the flare portion increases from the neck portion to the expanded end of the flare portion;

(b) moving apart a front face portion and a back face portion of the flare portion;

(c) gripping the front face portion and the back face portion of the flare portion between one or more holding clamps;

(d) providing a fitment on a mandrel, wherein the mandrel comprises one or more guide rings that define a groove;

(e) inserting the fitment via the mandrel through the expanded end of the flare portion and into the neck, wherein the fitment is provided in a first position in the neck of the flexible container;

(f) clamping the web material comprising the neck to prevent stretching of the material via one or more knife clamps that extend toward the mandrel and secure the web material comprising the neck between a surface of the one or more knife clamps and a surface of the one or more guide rings, wherein the one or more knife clamps defines a slot;

(g) cutting the web material at the neck via extending one or more cutting blades through the slot defined by the one or more knife clamps and into the groove defined by the one or more guide rings, thereby severing the flare portion from the neck of the container;

(h) moving the fitment to a second position in the neck of the flexible container;

(i) sealing a remaining portion of the web material comprising the neck to the fitment.

DETAILED DESCRIPTION

Figure 1:
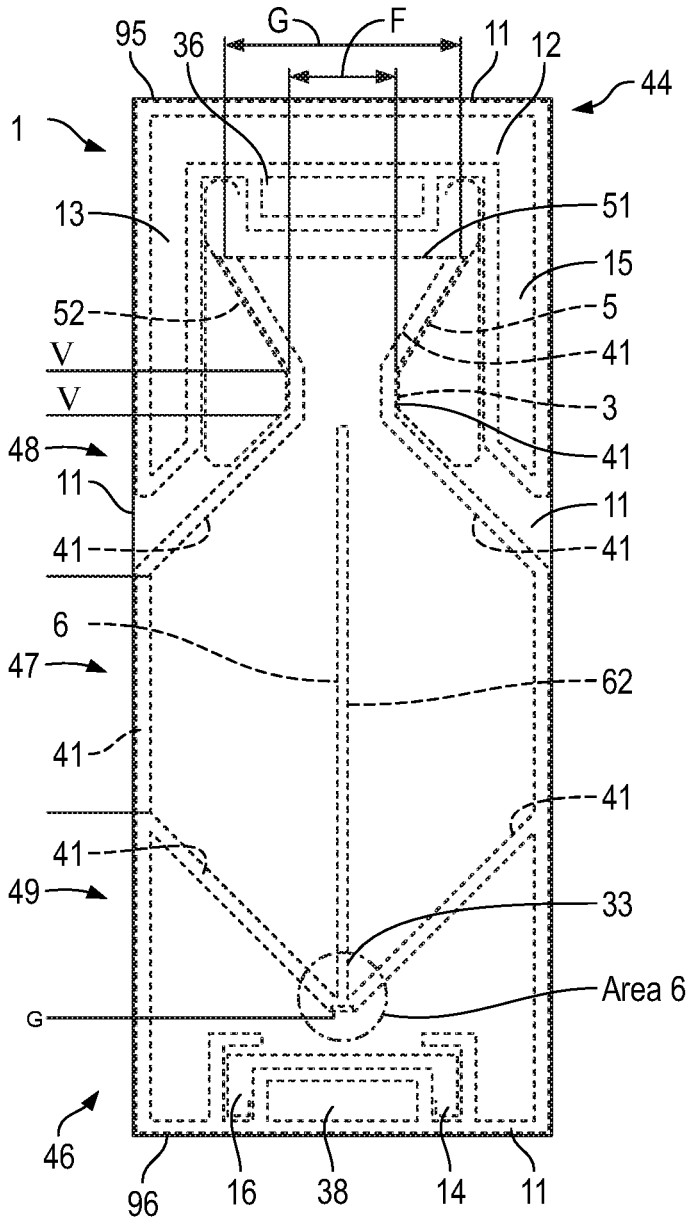
FIG. 1 is a front elevation view of a flexible container in a collapsed configuration provided in accordance with an embodiment of the present disclosure.

While this invention may be susceptible to embodiment in different forms, there are shown in the drawings and will be described herein in detail, specific embodiments with the understanding that the present disclosure is to be considered an exemplification of the principles of the invention, and is not intended to limit the invention to that as illustrated.

Embodiments of the present invention comprise flexible containers in a collapsed configuration and prior to (or lacking the) insertion of a fitment that may be formed using devices and methods of the prior art. To that end, U.S. patent application Ser. No. 14/800,312 is incorporated herein in its entirety for all purpose.

The present disclosure provides a process and a flexible container produced from the process. In an embodiment, the process includes (A) providing a flexible container with four panels. The four panels form (i) a body portion; (ii) a neck portion, and a flare portion that extends from the neck portion; (iii) a tapered transition portion between the body portion and the neck portion; and (iv) the neck portion has a reduced width, the flare portion has an expanded end; and the width of the flare portion gradually increases from the neck portion to the flare expanded end (i.e., the expanded end of the flare portion). The process includes (B) inserting a fitment into the flare portion from the expanded end.

Figure 10:
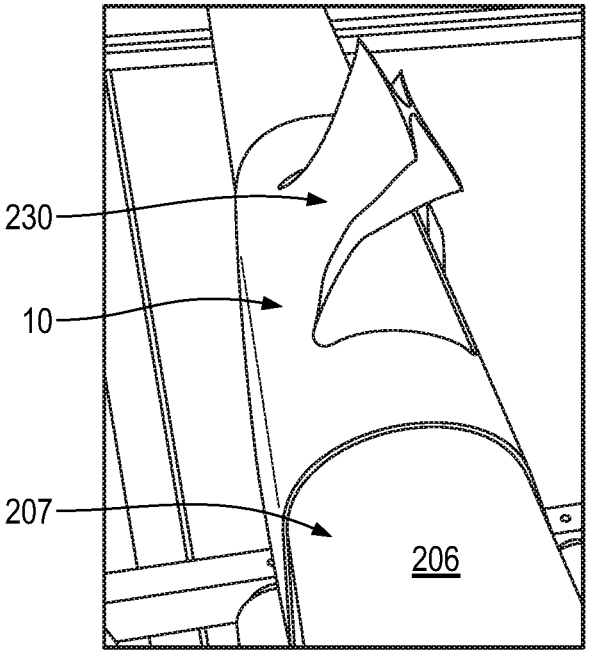
FIG. 10 is a perspective view of a flexible container in a collapsed configuration on a roller provided in accordance with an embodiment of the present disclosure.

The process includes providing a flexible container 10. Flexible container 10 has a collapsed configuration (as shown in FIG. 1 and FIG. 10) and has an expanded configuration (shown in FIGS. 3, 4, 5). FIG. 1 shows the flexible container 10 having a bottom section I, a body section II, a tapered transition section III, a neck section IV, and a flare section V. In the expanded configuration, the bottom section I forms a bottom segment 26. The body section II forms a body portion. The tapered transition section III forms a tapered transition portion. The neck section IV forms a neck portion. The flare section V forms a flare portion.

The flexible container 10 is made from four panels. During the fabrication process, the panels are formed when one or more webs of film material are sealed together. While the webs may be separate pieces of film material, it will be appreciated that any number of the seams between the webs could be "pre-made," as by folding one or more of the source webs to create the effect of a seam or seams. For example, if it were desired to fabricate the present flexible container from two webs instead of four, the bottom, left center, and right center webs could be a single folded web, instead of three separate webs. Similarly, one, two, or more webs may be used to produce each respective panel (i.e., a bag-in-a-bag configuration or a bladder configuration).

Figure 2:
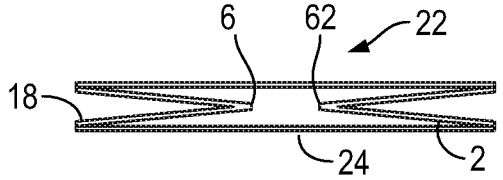
FIG. 2 is an exploded side elevation view of a panel sandwich provided in accordance with an embodiment of the present disclosure.

FIG. 2 shows the relative positions of the four webs as they form four panels (in a "one up" configuration) as they pass through the fabrication process. For clarity, the webs are shown as four individual panels, the panels separated and the heat seals not made. The constituent webs form first gusset panel 18, second gusset panel 20, front panel 22 and rear panel 24. The panels 18-24 are a multilayer film as discussed in detail below. The gusset fold lines 60 and 62 are shown in FIGS. 1 and 2.

As shown in FIG. 2, the folded gusset panels 18, 20 are placed between the rear panel 24 and the front panel 22 to form a "panel sandwich." The gusset panel 18 opposes the gusset panel 20. The edges of the panels 18-24 are configured, or otherwise arranged, to form a common periphery 11 as shown in FIG. 1. The flexible multilayer film of each panel web is configured so that the heat seal layers face each other. The common periphery 11 includes the bottom seal area including the bottom end of each panel.

When the container 10 is in the collapsed configuration, the flexible container is in a flattened, or in an otherwise evacuated state. The gusset panels 18, 20 fold inwardly (dotted gusset fold lines 60, 62 of FIG. 1) and are sandwiched by the front panel 22 and the rear panel 24.

Figure 3:
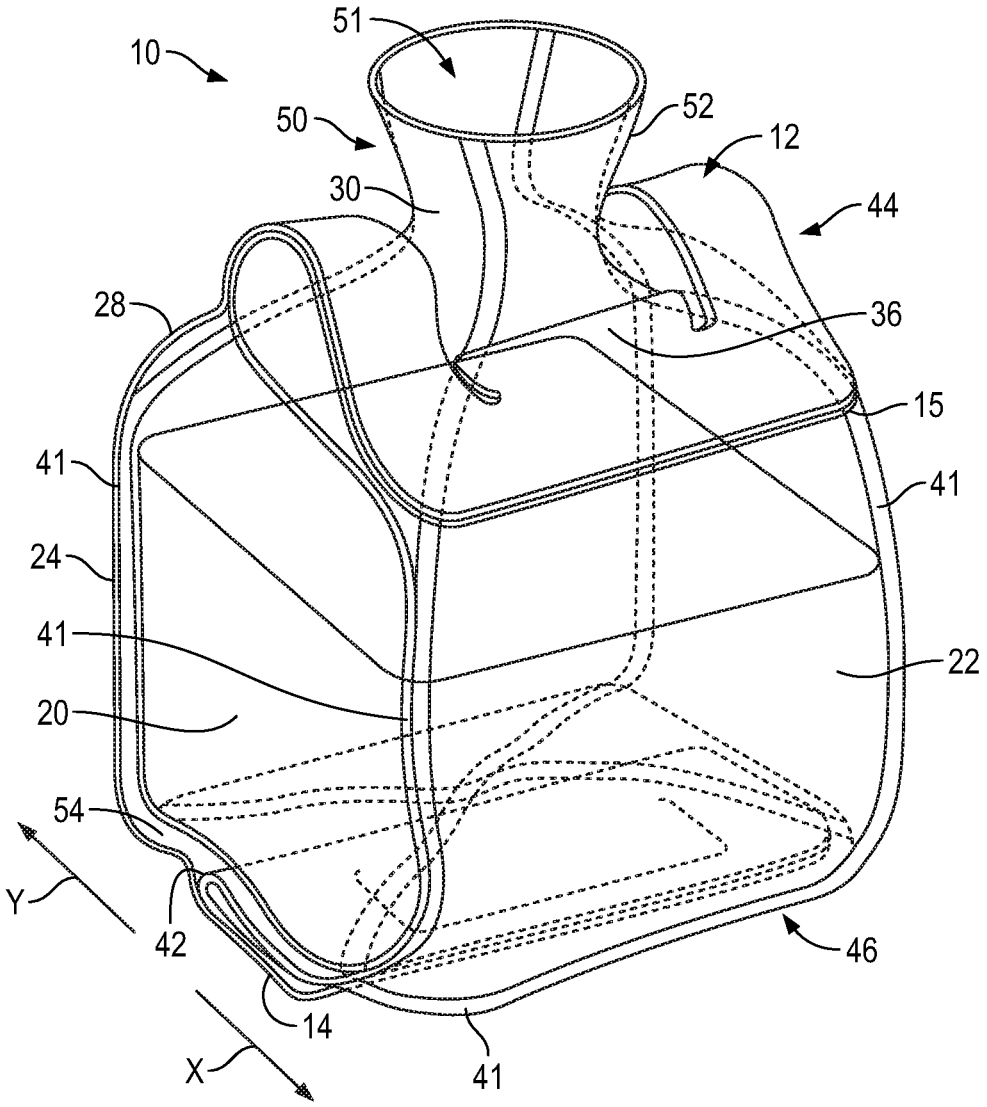
FIG. 3 is a perspective view of the flexible container of FIG. 1 in an expanded configuration provided in accordance with an embodiment of the present disclosure.
Figure 4:
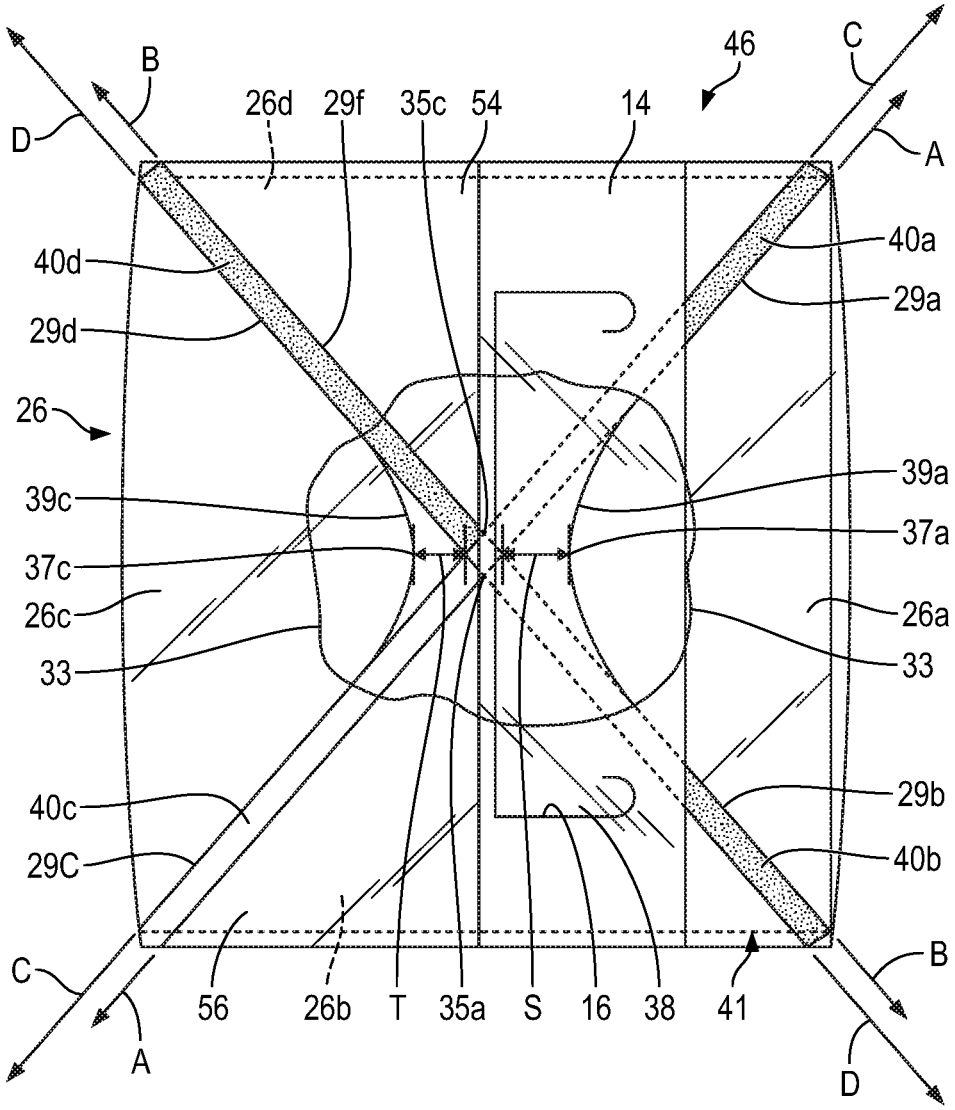
FIG. 4 is a bottom plan view of the expanded flexible container of FIG. 3 provided in accordance with an embodiment of the present disclosure.
Figure 5:
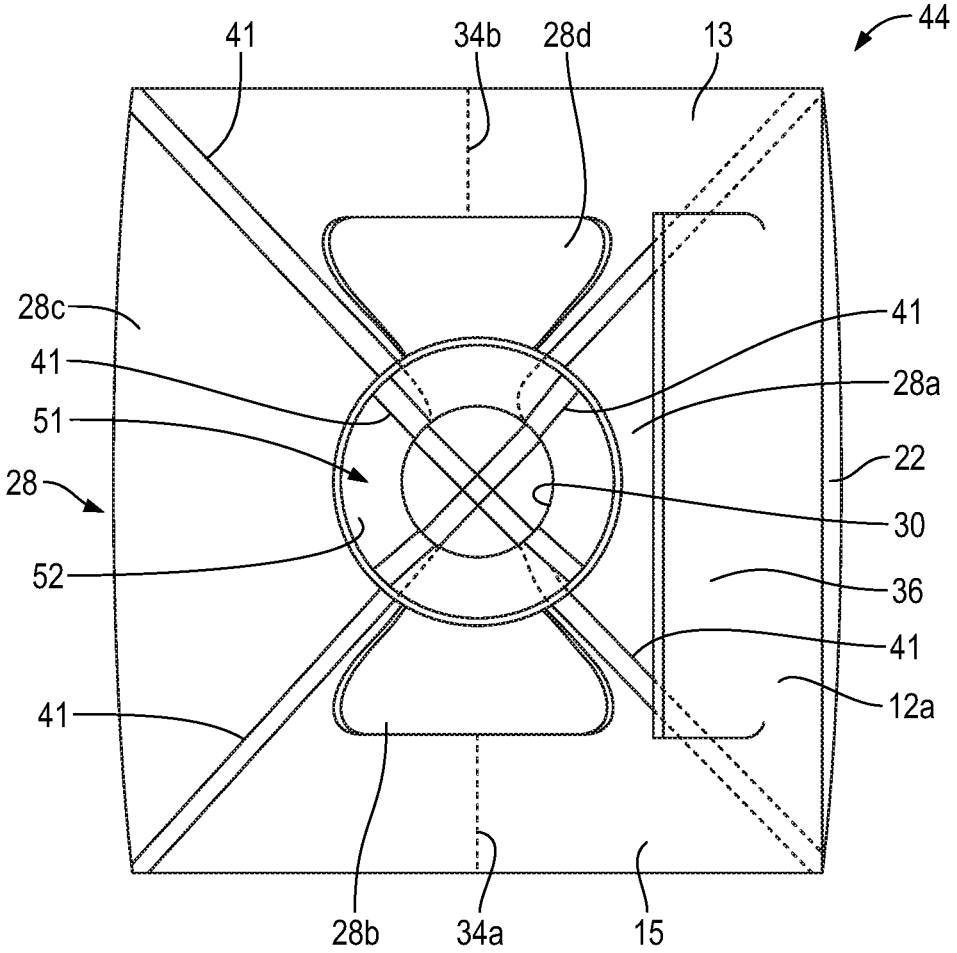
FIG. 5 is a top plan view of the flexible container of FIG. 3 provided in accordance with an embodiment of the present disclosure.

FIGS. 3-5 show flexible container 10 in the expanded configuration. The flexible container 10 has four panels, a front panel 22, a back panel 24, a first gusset panel 18 and a second gusset panel 20. The four panels 18, 20, 22, and 24 form the body section II and extend toward a top end 44 and extend toward a bottom end 46 of the container 10. Sections III, IV, and V (respective tapered transition section, neck section, and flare section) form a top segment 28. Section I (bottom section) forms a bottom segment 26.

The four panels 18, 20, 22 and 24 can each be composed of a separate web of film material. The composition and structure for each web of film material can be the same or different. Alternatively, one web of film material may also be used to make all four panels and the top and bottom segments. In a further embodiment, two or more webs can be used to make each panel.

In an embodiment, four webs of film material are provided, one web of film for each respective panel 18, 20, 22, and 24. The process includes sealing edges of each film to the adjacent web of film to form peripheral seals 41 (FIGS. 1, 3, 4, 5). The peripheral tapered seals 40 *a*-40 *d* are located on the bottom segment 26 of the container as shown in FIG. 4. The peripheral seals 41 are located on the side edges of the container 10. Consequently the process includes forming a closed bottom section I, a closed body section II, and a closed tapered transition section III.

To form the top segment 28 and the bottom segment 26, the four webs of film converge together at the respective end and are sealed together. For instance, the top segment 28 can be defined by extensions of the panels sealed together at the tapered transition section III, the neck section IV, and the flare section V. The top end 44 includes four top panels 28 *a*-28 *d* (FIG. 5) of film that define the top segment 28. The bottom segment 26 can be defined by extensions of the panels sealed together at the bottom section I. The bottom segment 26 can also have four bottom panels 26 *a*-26 *d* of film sealed together and can also be defined by extensions of the panels at the opposite end 46 as shown in FIG. 4.

The neck portion can extend from the transition portion. Alternatively, the neck portion can extend from one of the four panels of the body portion, or from a corner of the body portion.

In an embodiment, the neck 30 is positioned at a midpoint of the top segment 28. The neck 30 may (or may not) be sized smaller than a width of the body section III, such that the neck 30 can have an area that is less than a total area of the top segment 28. The location of the neck 30 can be anywhere on the top segment 28 of the container 10.

In an embodiment, the neck is formed from two or more panels. In a further embodiment, the neck 30 is formed from four panels.

Although FIGS. 1 and 3 show the flexible container 10 with a top handle 12 and a bottom handle 14, it is understood the flexible container may be fabricated without handles or with only one handle. When the flexible container has a top handle, the neck is preferably located on the top segment between the handle legs to facilitate easy pouring.

In an embodiment, the neck 30 is located in the top segment 28 and is centered between the legs 13 of the top handle 12.

The four panels of film that form the flexible container 10 extend from the body section II (forming body portion 47), to the tapered transition section III (forming tapered transition portion 48), to form a neck portion 30 (in the neck section IV) and a flare portion 50 (in the flare section V). The four panels of film also extend from the body section II to the bottom section I (forming bottom portion 49). When the flexible container 10 is in the collapsed configuration (FIG. 1), the neck portion 30 has a width that is less than the width of the tapered transition section III, includes the neck portion has a "reduced width." The flare portion 50 extends from the neck portion 30. FIGS. 1 and 3 show the flare portion 50 and the neck portion 30 form an access opening into the flexible container interior. As shown in FIGS. 1, 3 and 5, the flare portion 50 has an expanded end 51 and the width of the flare portion 50 gradually increases from the neck portion 30 to the expanded end 51. The flare sides 52 extend outwardly toward the handle legs 13, 15 when moving from the neck portion 30 to the expanded end 51. The panels are sealed together to form a closed bottom section, a closed body section, and a closed tapered transition section. Nonlimiting examples of suitable heating procedures include heat sealing and/or ultrasonic sealing. When the container 10 is in the expanded configuration, the expanded end 51 of the flare portion 50 is open or is otherwise unsealed. When the flexible container 10 is in the collapsed configuration, the expanded end 51 is unsealed and is openable. The open expanded end 51 permits access to the container interior through the flare portion 50 and the neck portion 30 as shown in FIGS. 3 and 5.

The expanded end 51 has a width G having a length that is greater than a width F of the neck portion 30, as shown in FIG. 1. In an embodiment, the length of width G (in millimeters, mm) is from 1.1, or 1.2, or 1.5, or 2.0, or 3.0, or 4.0 to 5.0, or 6.0, or 7.0, or 8.0 times greater than the length of width F.

When the flexible container 10 is in the expanded configuration (as shown in FIG. 3), the flare portion 50 defines a frustoconical-shaped inner volume whereby the diameter of the flare portion 50 increases gradually when moving from the neck portion 30 to the expanded end 51.

As shown in FIGS. 1, 3-4, the flexible bottom handle 14 can be positioned at a bottom end 46 of the container 10 such that the bottom handle 14 is an extension of the bottom segment 26.

Each panel includes a respective bottom face. FIG. 4 shows four triangle-shaped bottom faces 26 *a*-26 *d*, each bottom face being an extension of a respective film panel. The bottom faces 26 *a*-26*d* make up the bottom segment 26. The four panels 26 *a*-26 *d* come together at a midpoint of the bottom segment 26. The bottom faces 26 *a*-26 *d* are sealed together, such as by using a heat-sealing technology, to form the bottom handle 14. For instance, a weld can be made to form the bottom handle 14, and to seal the edges of the bottom segment 26 together. Nonlimiting examples of suitable heat-sealing technologies include hot bar sealing, hot die sealing, impulse sealing, high frequency sealing, or ultrasonic sealing methods.

Figure 6:
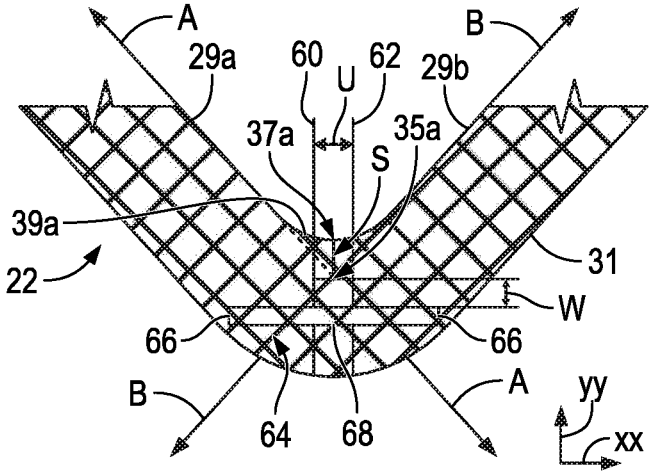
FIG. 6 is an enlarged view of area 6 of FIG. 1 provided in accordance with an embodiment of the present disclosure.

FIG. 4 shows bottom segment 26. Each panel 18, 20, 22, 24 has a respective bottom face 26 *a*-26 *d* that is present in the bottom segment 26. Each bottom face is bordered by two opposing peripheral tapered seals 40 *a*-40 *d*. Each peripheral tapered seal 40*a*-40*d* extends from a respective peripheral seal 41. The peripheral tapered seals for the front panel 22 and the rear panel 24 have an inner edge 29 *a*-29 *d* (FIG. 4) and an outer edge 31 (FIG. 6). The peripheral tapered seals 40 *a*-40 *d* converge at a bottom seal area 33 (FIG. 1, FIG. 4, FIG. 6).

The front panel bottom face 26*a* includes a first line A defined by the inner edge 29*a* of the first peripheral tapered seal 40 a and a second line B defined by the inner edge 29*b* of the second peripheral tapered seal 40*b*. The first line A intersects the second line B at an apex point 35*a* in the bottom seal area 33. The front panel bottom face 26*a* has a bottom distalmost inner seal point 37*a* ("BDISP 37 *a*"). The BDISP 37*a* is located on the inner edge.

In an embodiment, each peripheral tapered seal 40 *a*-40 *d* (outside edge) and an extended line from respective peripheral seal 41 (outside edge) form an angle G as shown in FIG. 1. The angle G is from 40° or 42°, or 44°, or 45° to 46°, or 48, or 50°. In an embodiment, angle G is 45°.

The bottom segment 26 includes a pair of gussets 54 and 56 formed thereat, which are essentially extensions of the bottom faces 26 *a*-26 *d*. The gussets 54 and 56 can facilitate the ability of the flexible container 10 to stand upright. These gussets 54 and 56 are formed from excess material from each bottom face 26 *a*-26 *d* that are joined together to form the gussets 54 and 56. The triangular portions of the gussets 54 and 56 comprise two adjacent bottom segment panels sealed together and extending into its respective gusset. For example, adjacent bottom faces 26*a* and 26*d* extend beyond the plane of their bottom surface along an intersecting edge and are sealed together to form one side of a first gusset 54. Similarly, adjacent bottom faces 26*c* and 26*d* extend beyond the plane of their bottom surface along an intersecting edge and are sealed together to form the other side of the first gusset 54. Likewise, a second gusset 56 is similarly formed from adjacent bottom faces 26 *a*-26 *b* and 26 *b*-26 *c*. The gussets 54 and 56 can contact a portion of the bottom segment 26, where the gusset portions gussets 54 and 56 can contact bottom faces 26*b* and 26*d* covering them, while bottom segment panels 26*a* and 26*c* remain exposed at the bottom end 46.

As shown in FIGS. 3-4, the gussets 54 and 56 of the flexible container 10 can further extend into the bottom handle 14. In the aspect where the gussets 54 and 56 are positioned adjacent bottom segment panels 26*b* and 26*d*, the bottom handle 14 can also extend across bottom faces 26*b* and 26*d*, extending between the pair of panels 18 and 20. The bottom handle 14 can be positioned along a center portion or midpoint of the bottom segment 26 between the front panel 22 and the rear panel 24.

The top handle 12 and the bottom handle 14 can comprise up to four plys of film sealed together for a four panel container 10. When more than four panels are used to make the container, the handles can include the same number of panels used to produce the container. Any portion of the handles 12, 14 where all four plys are not completely sealed together by the heat-sealing method, can be adhered together in any appropriate manner, such as by a tack seal to form a fully-sealed multilayer handle. Alternatively, the top handle can be made from as few as a single ply of film from one panel only or can be made from only two plies of film from two panels. The handles 12, 14 can have any suitable shape and generally will take the shape of the film end. For example, typically the web of film has a rectangular shape when unwound, such that its ends have a straight edge. Therefore, the handles 12, 14 would also have a rectangular shape.

Additionally, the bottom handle 14 can contain a handle opening 16 or cutout section therein sized to fit a user's hand, as can be seen in FIG. 1. The handle opening 16 can be any shape that is convenient to fit the hand and, in one aspect, the handle opening 16 can have a generally oval shape. In another aspect, the handle opening 16 can have a generally rectangular shape. Additionally, the handle opening 16 of the bottom handle 14 can also have a flap 38 that comprises the cut material that forms the handle opening 16. To define the handle opening 16, the handle 14 can have a section that is cut out of the multilayer handle 14 along three sides or portions while remaining attached at a fourth side or lower portion. This provides a flap of material 38 that can be pushed through the opening 16 by the user and folded over an edge of the handle opening 16 to provide a relatively smooth gripping surface at an edge that contacts the user's hand. If the flap of material were completely cut out, this would leave an exposed fourth side or lower edge that could be relatively sharp and could possibly cut or scratch the hand when placed there.

Furthermore, a portion of the bottom handle 14 attached to the bottom segment 26 can contain a dead machine fold 42 or a score line that provides for the handle 14 to consistently fold in the same direction, as illustrated in FIG. 3. The machine fold 42 can comprise a fold line that permits folding in a first direction toward the front side panel 22 and restricts folding in a second direction toward the rear panel 24. The term "restricts" as used throughout this application can mean that it is easier to move in one direction, or the first direction, than in an opposite direction, such as the second direction. The machine fold 42 can cause the handle 14 to consistently fold in the first direction because it can be thought of as providing a generally permanent fold line in the handle that is predisposed to fold in the first direction X, rather than in the second direction Y. This machine fold 42 of the bottom handle 14 can serve multiple purposes, one being that when a user is transferring the product from the container 10 they can grasp the bottom handle 14 and it will easily bend in the first direction X to assist in pouring. Secondly, when the flexible container 10 is stored in an upright position, the machine fold 42 in the bottom handle 14 encourages the handle 14 to fold in the first direction X along the machine fold 42, such that the bottom handle 14 can fold underneath the container 10 adjacent one of the bottom segment panels 26 a, as shown in FIG. 4. The weight of the product can also apply a force to the bottom handle 14, such that the weight of the product can further press on the handle 14 and maintain the handle 14 in the folded position in the first direction X. As will be discussed herein, the top handle 12 can also contain a similar machine fold that also allows it to fold consistently in the same first direction X as the bottom handle 14.

Additionally, as the flexible container 10 is evacuated and less product remains, the bottom handle 14 can continue to provide support to help the flexible container 10 to remain standing upright unsupported and without tipping over. Because the bottom handle 14 is sealed generally along its entire length extending between the pair of gusset panels 18 and 20, it can help to keep the gussets 54 and 56 (FIG. 1, FIG. 3) together and continue to provide support to stand the container 10 upright even as the container 10 is emptied.

As seen in FIGS. 1, 3, and 5, the top handle 12 can extend from the top segment 28 and, in particular, can extend from the four panels 28 *a*-28 *d* that make up the top segment 28. The four panels 28 *a*-28 *d* of film that extend into the top handle 12 are all sealed together to form a multi-layer top handle 12. The top handle 12 can have a U-shape and, in particular, an upside down U-shape with a horizontal upper handle portion 12*a* having two pairs of spaced legs 13 and 15 extending therefrom. The pair of legs 13 and 15 extend from the top segment 28, adjacent the neck portion 30.

A portion of the top handle 12 can extend above the neck portion 30 and above the top segment 28 when the handle 12 is extended in a position perpendicular to the top segment 28 and, in particular, the entire upper handle portion 12*a* can be above the flare portion 50 and the top segment 28. The two pairs of legs 13 and 15 along with the upper handle portion 12*a* together make up the handle 12 surrounding a handle opening that allows a user to place their hand there through and grasp the upper handle portion 12*a* of the handle 12.

As with the bottom handle 14, the top handle 12 also can have a dead machine fold that permits folding in a first direction toward the front side panel 22 and restricts folding in a second direction toward the rear side panel 24. The machine fold can be located in each of the pair of legs 13, 15 at a location where the seal begins. The handle 12 can be adhered together, such as with a tack adhesive, for example. The machine fold in the handle 12 can allow for the handle 12 to be inclined to fold or bend consistently in the same first direction X as the bottom handle 14, rather than in the second direction Y. As shown in FIGS. 1, 3, and 5, the handle 12 can likewise contain a flap portion 36, that folds upwards toward the upper handle portion 12*a* of the handle 12 to create a smooth gripping surface of the handle 12, as with the bottom handle 14, such that the handle material is not sharp and can protect the user's hand from getting cut on any sharp edges of the handle 12.

In an embodiment, either top handle 12 or bottom handle 14 can be "a punch-out handle," that is, a handle formed by a process the cuts out or "punches" film material from the flexible container, thereby removing film material from the flexible container. The punch-out handle does not have, or is otherwise void of, flap portion 36 (for top handle 12) and/or flap portion 38 (for bottom handle 14).

In an embodiment, a grip member can be attached to either the top handle 12 or the bottom handle 14. The grip member can be placed around top handle 12 and/or bottom handle 14. Grip member can also be molded into the flexible container. The grip member can be adhesively attached to any portion of the flexible container. The grip member provides additional comfort to the user when carrying, or otherwise using, the flexible container. The grip member provides additional reinforcement to the flexible container. In a further embodiment, the grip member can be removed from the flexible container 10 after use and be re-used with another flexible container.

When the container 10 is in a rest position, such as when it is standing upright on its bottom segment 26, as shown in FIG. 3, the bottom handle 14 can be folded underneath the container 10 along the bottom machine fold 42 in the first direction X, so that it is parallel to the bottom segment 26 and adjacent bottom panel 26*a*, and the top handle 12 will automatically fold along Its machine fold in the same first direction X, with a front surface of the handle 12 parallel to a top section or panel 28*a* of the top segment 28. The top handle 12 folds in the first direction X, rather than extending straight up, perpendicular to the top segment 28, because of the machine fold. Both handles 12 and 14 are inclined to fold in the same direction X, such that upon dispensing, the handles can fold the same direction, relatively parallel to its respective end panel or end segment, to make dispensing easier and more controlled. Therefore, in a rest position, the handles 12 and 14 are both folded generally parallel to one another. Additionally, the container 10 can stand upright even with the bottom handle 14 positioned underneath the upright container 10.

The material of construction of the flexible container 10 can comprise food-grade plastic. For instance, nylon, polypropylene, polyethylene such as high density polyethylene (HDPE) and/or low density polyethylene (LDPE) may be used as discussed later. The film of the plastic container 10 can have a thickness and barrier properties that is adequate to maintain product and package integrity during manufacturing, distribution, product shelf life and customer usage.

In an embodiment, the flexible multilayer film has a thickness from 100 micrometers, or 200 micrometers, or 250 micrometers to 300 micrometers, or 350 micrometers, or 400 micrometers.

In an embodiment, each panel is made from a flexible multilayer film having at least one, or at least two, or at least three layers. The flexible multilayer film is resilient, flexible, deformable, and pliable. The structure and composition of the flexible multilayer film for each panel may be the same or different. For example, each of the four panels can be made from a separate web, each web having a unique structure and/or unique composition, finish, or print. Alternatively, each of the four panels can be the same structure and the same composition.

In an embodiment, each panel 18, 20, 22, 24 is a flexible multilayer film having the same structure and the same composition.

The flexible multilayer film may be (i) a coextruded multilayer structure or (ii) a laminate, or (iii) a combination of (i) and (ii). In an embodiment, the flexible multilayer film has at least three layers: a seal layer, an outer layer, and a tie layer between. The tie layer adjoins the seal layer to the outer layer. The flexible multilayer film may include one or more optional inner layers disposed between the seal layer and the outer layer.

In an embodiment, the flexible multilayer film is a coextruded film having at least two, or three, or four, or five, or six, or seven to eight, or nine, or 10, or 11, or more layers. Some methods, for example, used to construct films are by cast co-extrusion or blown co-extrusion methods, adhesive lamination, extrusion lamination, thermal lamination, and coatings such as vapor deposition. Combinations of these methods are also possible.

In an embodiment, the flexible multilayer film is co-extruded.

In FIG. 6, an overseal 64 is formed where the four peripheral tapered seals 40 *a*-40 *d* converge in the bottom seal area. The overseal 64 includes 4-ply portions 66, where a portion of each panel is heat sealed to a portion of every other panel. Each panel represents 1-ply in the 4-ply heat seal. The overseal 64 also includes a 2-ply portion 68 where two panels (front panel and rear panel) are sealed together. Consequently, the "overseal," as used herein, is the area where the peripheral tapered seals converge that is subjected to a subsequent heat seal operation (and subjected to at least two heat seal operations altogether). The overseal is located in the peripheral tapered seals and does not extend into the chamber of the flexible container 10.

In an embodiment, the flexible container 10 has a volume from 0.050 liters (L), or 0.1 L, or 0.15 L, or 0.2 L, or 0.25 liters (L), or 0.5 L, or 0.75 L, or 1.0 L, or 1.5 L, or 2.5 L, or 3 L, or 3.5 L, or 4.0 L, or 4.5 L, or 5.0 L to 6.0 L, or 7.0 L, or 8.0 L, or 9.0 L, or 10.0 L, or 20 L, or 30 L.

Figure 7:
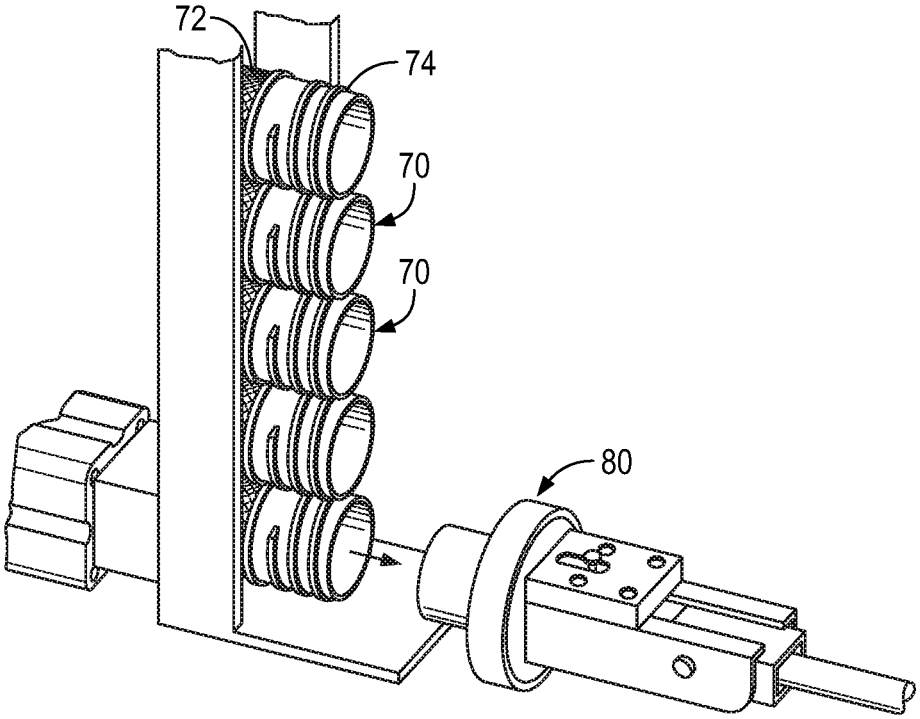
FIG. 7 is a perspective view of a mandrel and a fitment provided in accordance with an embodiment of the present disclosure.
Figure 8:
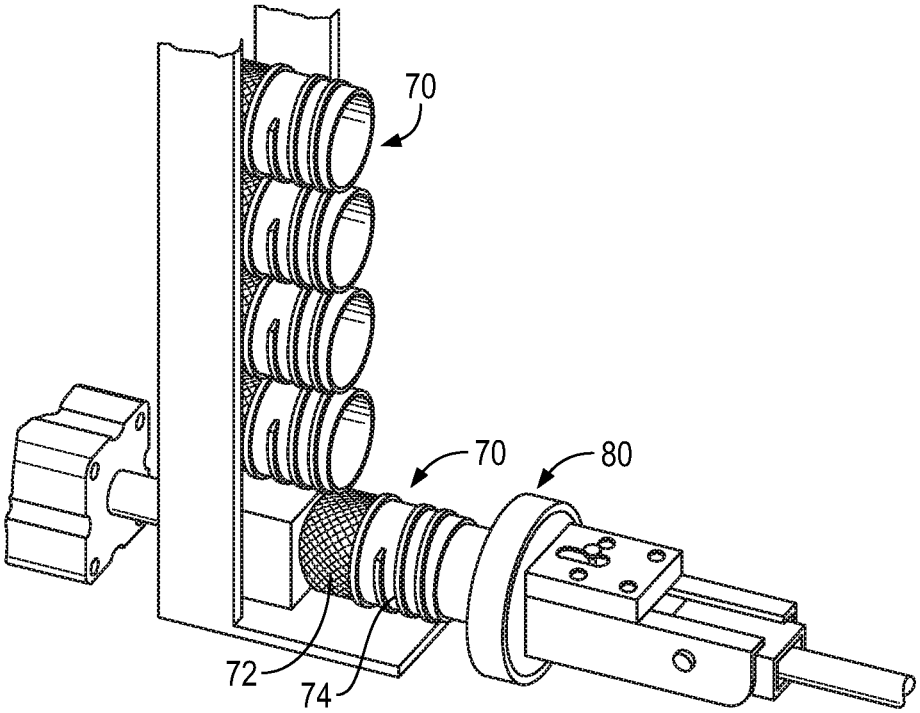
FIG. 8 is a perspective view of a mandrel supporting a fitment provided in accordance with an embodiment of the present disclosure.

The present process includes inserting a fitment into the flare portion 50 from the expanded end 51. As shown in FIGS. 7-8, the fitment 70 includes a base 72 and a closure 74. Although the base 72 has a circular cross-sectional shape, it is understood that the base 72 can have other cross-sectional shapes such as a polygonal cross-sectional shape, for example. The base 72 with circular cross-sectional shape is distinct from fitments with canoe-shaped bases used for conventional two-panel flexible pouches.

In an embodiment, the fitment 70 can be made of a rigid construction and can be formed of any appropriate plastic, such as high density polyethylene (HDPE), low density polyethylene (LDPE), polypropylene (PP), and combinations thereof. The location of the neck portion 30 can be anywhere on the top segment 28 of the container 10. In an embodiment the neck portion 30 is located at the center or midpoint of the top segment 28.

In an embodiment, the process includes supporting the fitment 70 on a mandrel 80, and subsequently inserting the fitment 70 first into the expanded end 51, then into the flare portion 50, and then into the neck portion 30. A plurality of fitments may be fed sequentially to the mandrel 80 by an automated feed system as shown in FIGS. 7-8. FIG. 7 shows the mandrel 80 moving into position to receive and support one of a plurality of fitments 70. Although FIG. 7 shows the mandrel 80 having a length similar to the length of the closure 74, it is understood that the mandrel 80 can have a length the same as, or substantially the same as, or greater than, the length of the fitment 70. In other words, the mandrel 80 can partially support, or fully support, the fitment 70, the base 72, the closure 74, and any combination thereof.

FIG. 8 shows the fitment 70 supported on the mandrel 80. The outer diameter of the mandrel 80 is mated to the inner diameter of the fitment 70 such that the fitment 70 fits, snugly fits, or friction fits on the mandrel 80. In other words, the mandrel 80 is configured to fit into/through the closure 74, or into/through both the closure 74 and the base 72.

In an embodiment, the mandrel 80 is a component of an automated system, the mandrel a component of a movable arm as shown in FIGS. 7-8.

Devices and methods for the installation of a fitment 70, 270 into a container 10, 210 will now be discussed. The characteristics and structure of fitments 70, 270 may be substantially similar or identical, although the method of fitment 70, 270 installation and resulting finished container 10, 210 comprising the fitment 70, 270 is novel and inventive over the prior art. Additionally, containers 10, 210 may be substantially similar or identical in collapsed form prior to fitment 70, 270 installation, and to the extent containers 210 may be configured to be provided, for example, on a roll 200 as depicted in FIG. 9, novel and inventive modifications between container 10 and container 210 provided in a collapsed configuration are described below.

Figure 9:
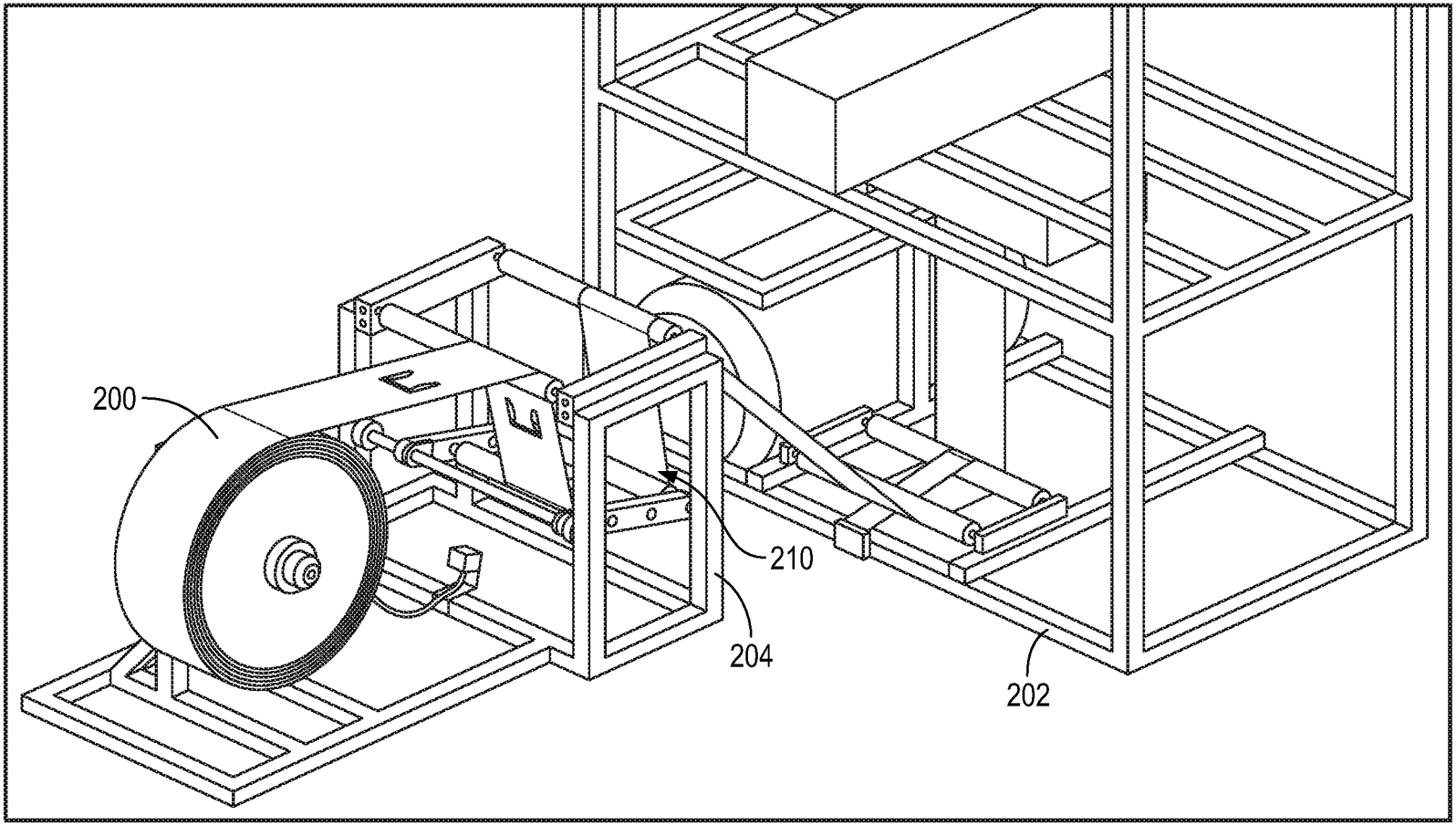
FIG. 9 is a perspective view of a roll of flexible containers being fed into an insert sealing machine provided in accordance with an embodiment of the present disclosure.

FIG. 9 shows a plurality of flexible containers 210 provided in a collapsed configuration on the roll 200 being fed into insert sealing machine 202. A pouch (container) machine (not shown) is used to form the flexible containers 210 in a collapsed configuration as provided in accordance with embodiments of the present invention, wherein the plurality of flexible containers 210 preferably remain temporarily connected along top and bottom edges 95, 96 at common periphery 11 (see FIG. 1), thus forming the roll 200. The pouch machine winds the flexible containers 210 onto the roll 200 that is set on an unwind stand 204. The roll 200 of containers 210 is then fed into the insert sealing machine 202 for the purpose of fitment 270 installation into each container 210, as described herein.

FIG. 10 shows a neck portion 230 deflecting away from the balance of the container 210 and a surface 206 of roller 207 of the unwind stand 204. This occurs in some embodiments of containers 10 because the expanded end 51 is not directly connected to legs 13, 15 after the container 10 is formed in a collapsed configuration (see FIG. 1). This deflection or disorientation of the flare portion 50 from the balance of the collapsed container 10 on the roller 207 can cause production problems when the roll 200 is fed into the insert sealing machine 202. For example, the preferred and efficient format of the container 210 in a collapsed configuration as it is fed into insert sealing machine 202 is for the container 210 to be fully collapsed and provided in a uniform alignment because otherwise deflected portions, such as expanded end 51 of container 10, can catch on portions of the insert sealing machine 202, such as attachment devices 234, that are used to efficiently move the containers 210 from the roll 200 and through the machine 202 for fitment 270 installation.

Figure 11:
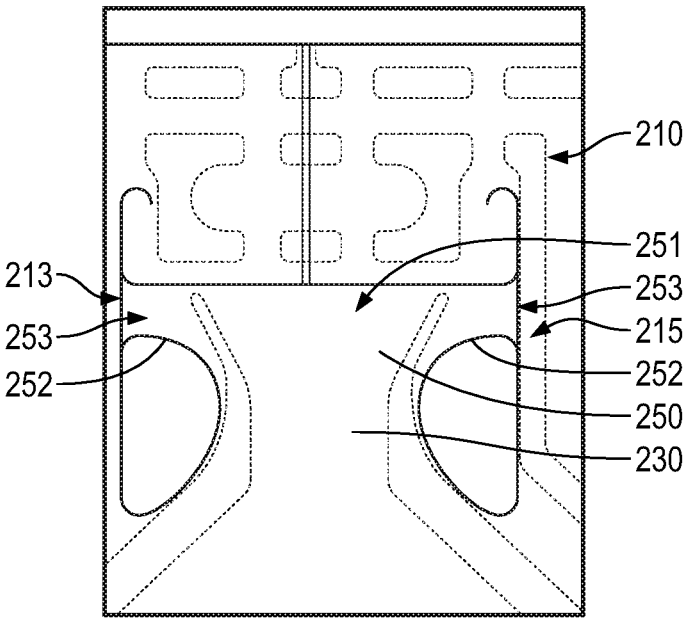
FIG. 11 is a front elevation view of a flexible container in a collapsed configuration and having connecting tabs provided in accordance with an embodiment of the present disclosure.

Accordingly, as shown in FIG. 11, some preferred embodiments of the present invention comprise container 210 provided in a collapsed configuration. Prior to fitment 270 installation, container 210 may comprise the same structure and be formed in the same manner as described above for container 10, except that some preferred embodiments of container 210 comprise an expanded end 251 that is preferably wider than expanded end 51, wherein expanded end 251 comprises tab portions 252 that remain at least partially attached to the legs 213, 215 when the expanded end 251 is formed in container 210. Preferably, when a die of the pouch machine is used to cut the container 210 as flare portion 250 is formed, the die will cut incompletely through and be configured to leave connected portions 253 that provide a connection between tab portions 252 and legs 213, 215. The connected portions 253 are comprised of the flexible film that forms the container 210, and have a width that is preferably approximately 0.7 mm wide. It is contemplated that the width of the connected portions 253 may be wider or narrower depending on the material type comprising container 210, thickness of material comprising container 210, and intended application(s) for container 210. The connected portions 253 keep expanded end 251 aligned with the balance of the container 210 as it is fed into and through the insert sealing machine 202, such that the expanded end 251 does not disadvantageously deflect away from the container 210 on the roll 200.

Figure 12:
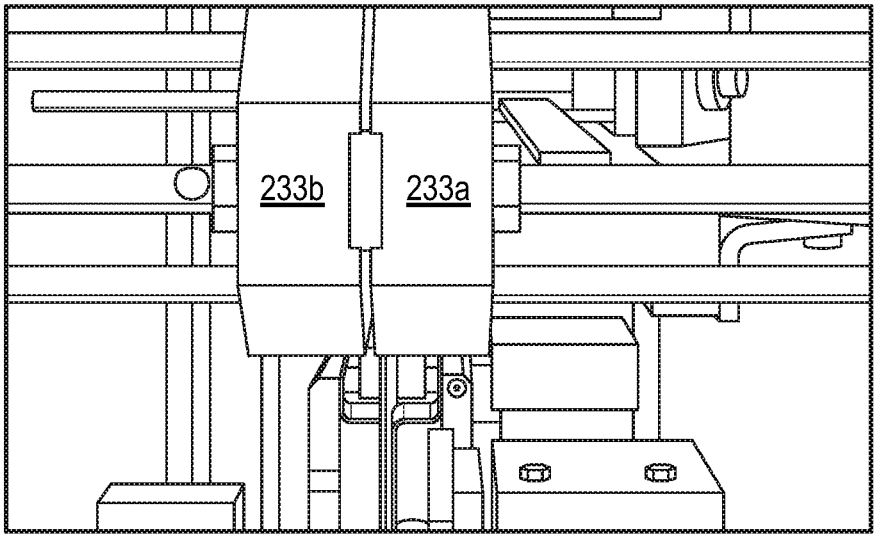
FIG. 12 is a perspective view of a flexible container in a collapsed configuration shown between container blade clamps provided in accordance with an embodiment of the present disclosure.
Figure 13:
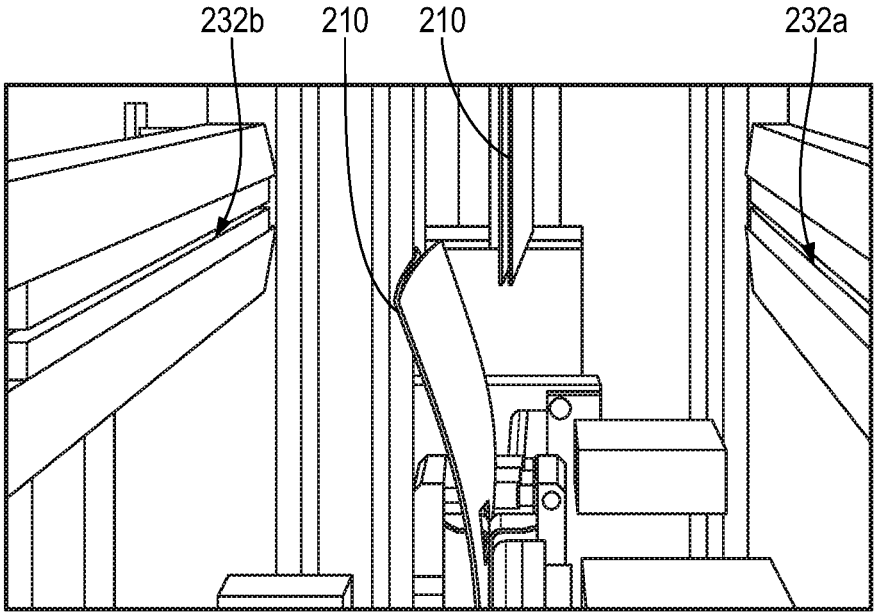
FIG. 13 is a perspective view of a flexible container in a collapsed configuration shown severed from a roll of containers by container blades provided in accordance with an embodiment of the present disclosure.

As shown in FIGS. 12 and 13, in some preferred embodiments of the present invention, once roll 200 is loaded into machine 202, the roll 200 will unwind such that at least one collapsed container 210 travels to container blades 232*a,b* housed in container blade clamps 233*a,b* which enclose and sever sequential edges 95, 96 between two containers 210 at periphery 11 (see also FIG. 1).

Figure 14:
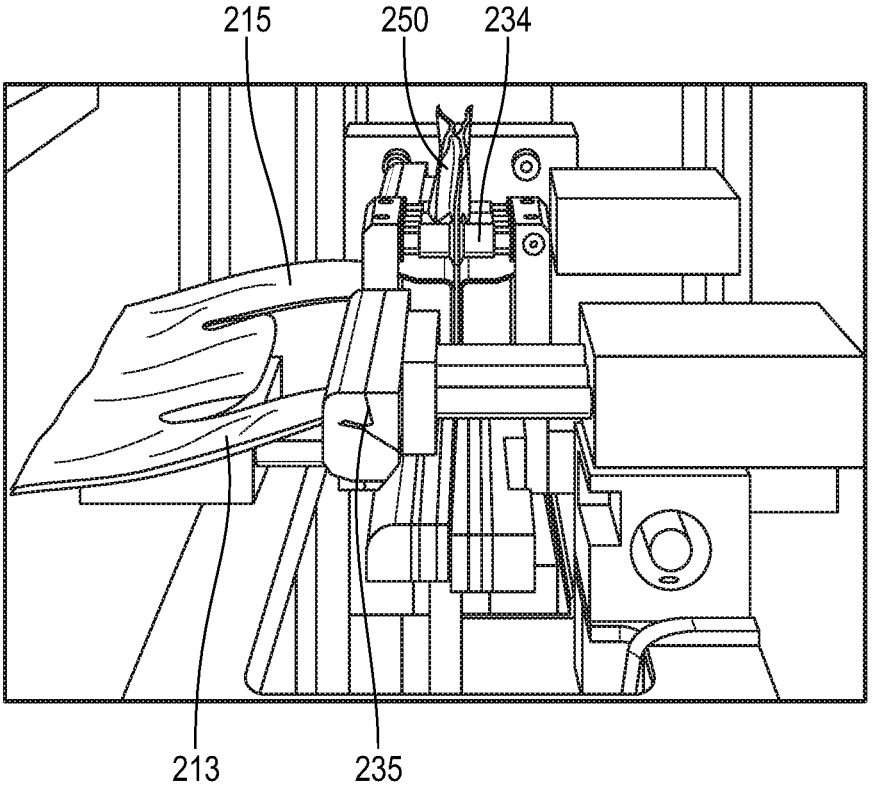
FIG. 14 is a perspective view of a flexible container in a collapsed configuration shown having a handle portion moved away from a neck portion so as to sever connecting portions there between, as provided in accordance with an embodiment of the present disclosure.

As shown in FIG. 14, in some preferred embodiments of the present invention, once edges 95, 96 are severed, one or more attachment devices 234 are provided at opposing portions of neck 230. Attachment devices 234 may be suction cups comprising a partial vacuum at opposing front face and back face portions 222, 224 of container 210, as shown in FIG. 14, such that neck 230 is held in a stable position. Then, one or more severing pads 235 is provided at handle legs 213, 215, wherein the pads 235 move the handle legs 213, 215 away from the neck 230 such that connected portions 253 are severed. For example, pads 235 may be installed on ram 236, wherein the pads 235 push handle 212 away from neck 230.

Figure 15:
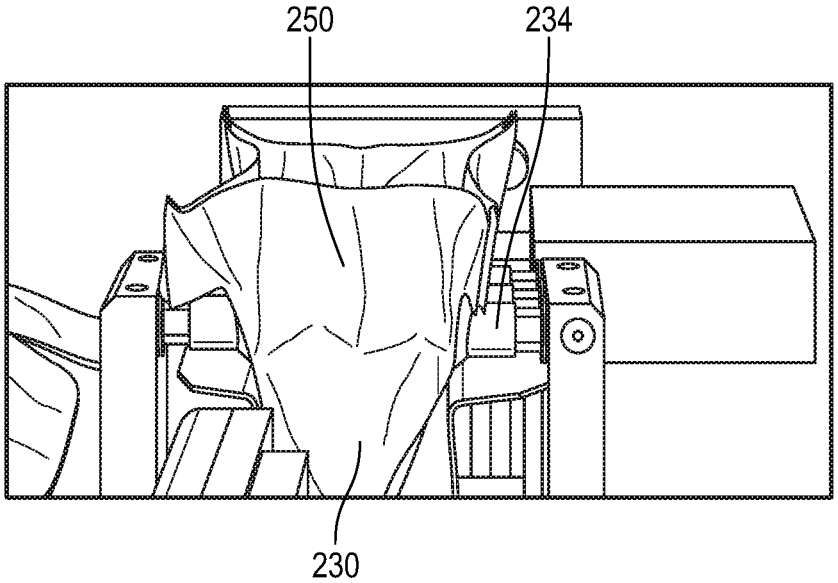
FIG. 15 is a perspective view of a flexible container in a collapsed configuration shown having a neck portion opened by attachment devices, such as suction cups, the neck being prepared for installation of a fitment therein, as provided in accordance with an embodiment of the present disclosure.

As shown in FIG. 15, in some preferred embodiments of the present invention, attachment devices 234 at opposing face portions 222, 224 of neck 230 move apart while holding the respective face portion 222, 224 that the attachment devices 234 are attached to, thus opening the neck 230 for installation of fitment 270 therein.

Figure 16:
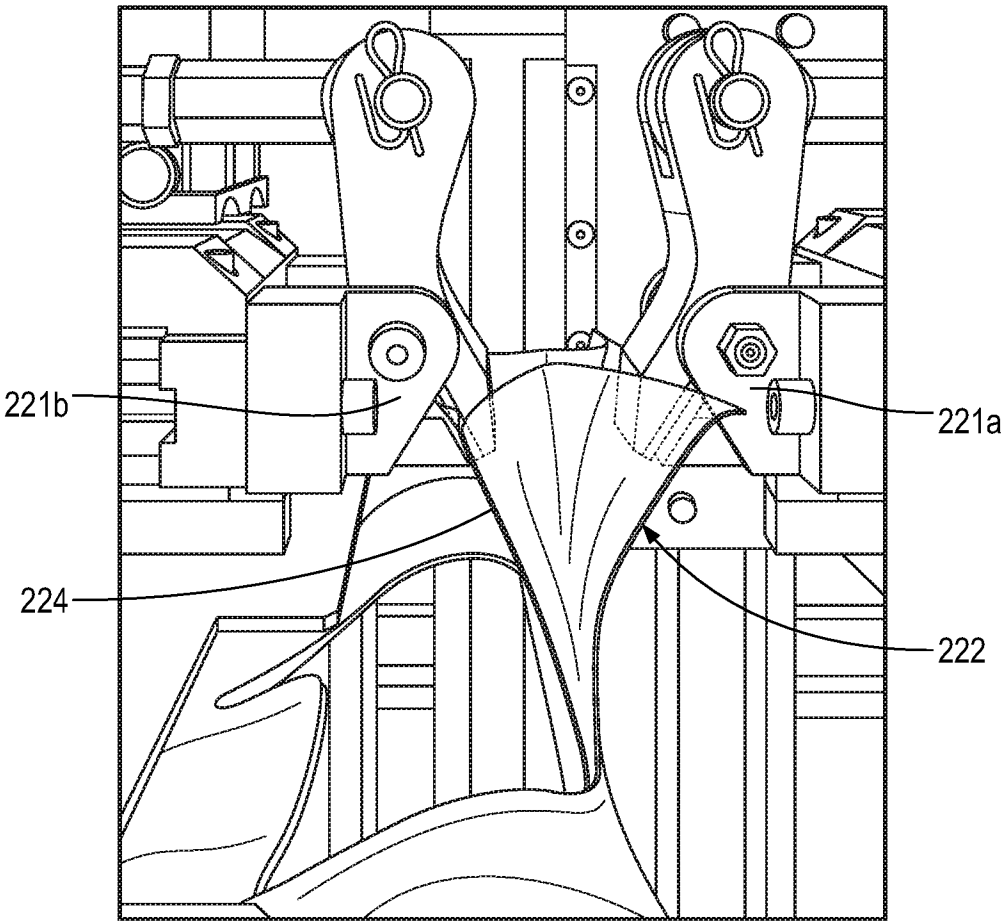
FIG. 16 is a perspective view of a flexible container in a collapsed configuration, wherein a neck portion is shown held in a clamp of an insert sealing machine, provided in accordance with an embodiment of the present disclosure.

FIG. 16 shows a next step of fitment 270 installation in container 210 of the insert sealing machine 202. As shown, the container 210 is placed in a position such that holding clamps 221*a*, 221*b* grab and hold open front face portion 222 and back face portion 224 of the expanded end 251, the neck 230 having been opened for installation of the fitment 270, as shown in FIG. 15. More specifically, clamp 221*a* will preferably pinch and hold portion 222 of expanded end 251 and clamp 221*b* will preferably pinch and hold portion 224 of expanded end 251. The aforementioned clamping configuration may be reversed with respect the front and back face portions 222, 224, as will be appreciated by those of ordinary skill in the art. As shown, the clamps 221*a,b* preferably draw away from each other and spread apart the expanded end 251 in preparation for installation of the fitment 270 in the neck 230.

Figure 17:
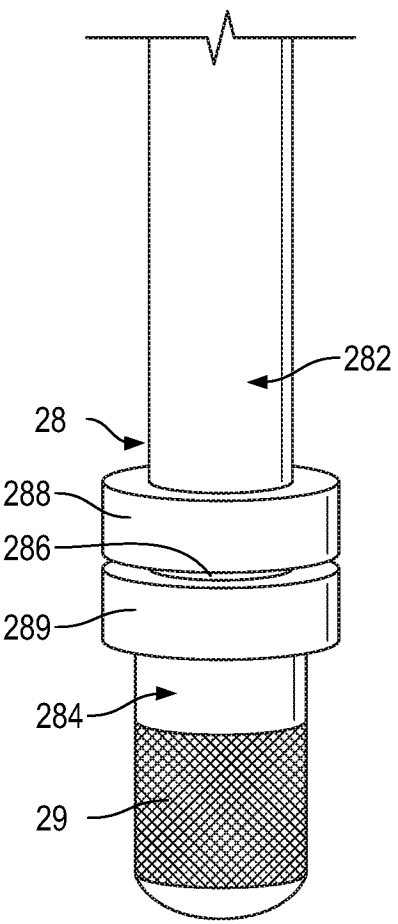
FIG. 17 is a perspective view of a mandrel provided in accordance with an embodiment of the present invention.

As shown in FIG. 17*a* mandrel 280 is provided in accordance with embodiments of the present invention. The mandrel 280 comprises a shaft 282, a base 284, a groove 286, and guide rings 288, 289. The mandrel 280 is comparable in construction and operation with respect to mandrel 80, except for at least two distinctions. First, the mandrel 280 preferably does not rotate for the fitment 270 installation in container 210. Second, the mandrel 280 comprises the groove 286 as shown, the significance of which will be further explained below. In an embodiment, the outer surface of the base 284 comprises a surface texture 290. The groove 286 preferably radially extends around a circumference of the mandrel 280, the circumference preferably being smaller than a circumference of guide ring 288 and a circumference of guide ring 289.

In an embodiment, the fitment 270 excludes fitments with oval, wing-shaped, eye-shaped, or canoe-shaped bases.

Figure 18:
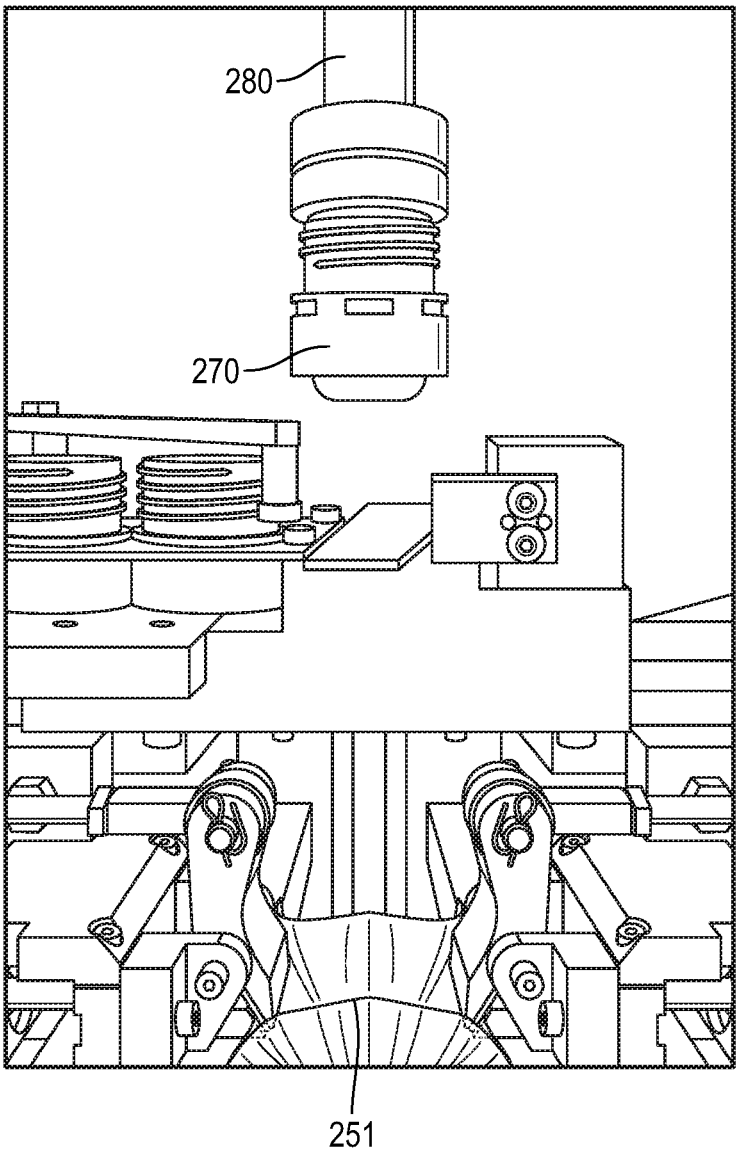
FIG. 18 is a perspective view of the mandrel of FIG. 13, the mandrel having a fitment positioned thereon and prepared for positioning in the neck of a flexible container as provided in accordance with an embodiment of the present invention.

As shown in FIG. 18, the mandrel 280 as shown has now taken up the fitment 270 from fitment supply line 271 by way of a friction, compression, or similar snug fit, wherein the fitment 270 now rests on the base 284. The mandrel 280 is then inserted into the expanded end 251 of the neck 230 to a first position where the groove 286 is complementarily and laterally aligned with cutting blades 259*a, b* (see FIG. 23 and FIG. 28).

Although FIG. 18 shows the mandrel 280 (with fitment 270) moving toward the flexible container 210, it is understood that the flexible container 210 may be moved toward the mandrel 280 (supporting the fitment 270), the mandrel 280 being stationary, or intermittently stationary and intermittently movable, during the insertion process. Alternatively, the process may entail a system whereby the flexible container 210 and the mandrel 280 each is movable with respect to the other, such that the flexible container 210 and the fitment 270 (supported by the mandrel 280) can each be moved toward and away from the other in order to insert the fitment 270 into the expanded end 251, through flare portion 250, and into the neck portion 230.

Figure 19:
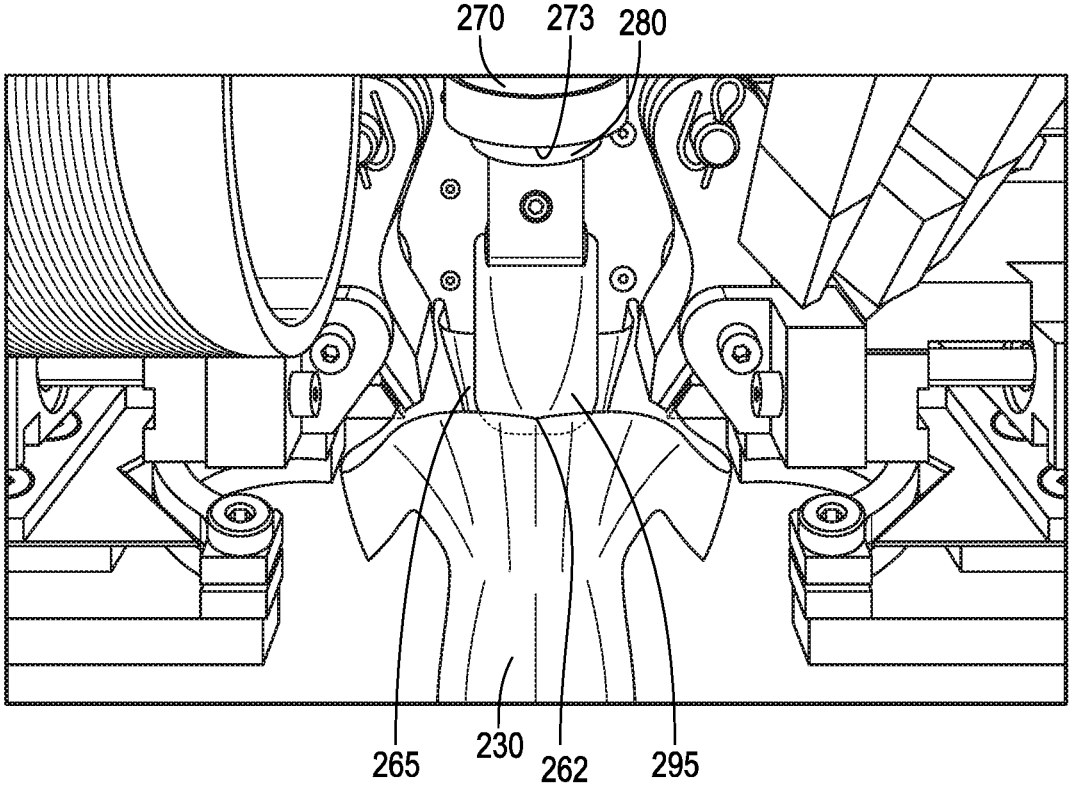
FIG. 19 is a perspective view of a flexible container in a collapsed configuration, wherein a gusset deflector is positioned in the neck of the flexible container.
Figure 20:
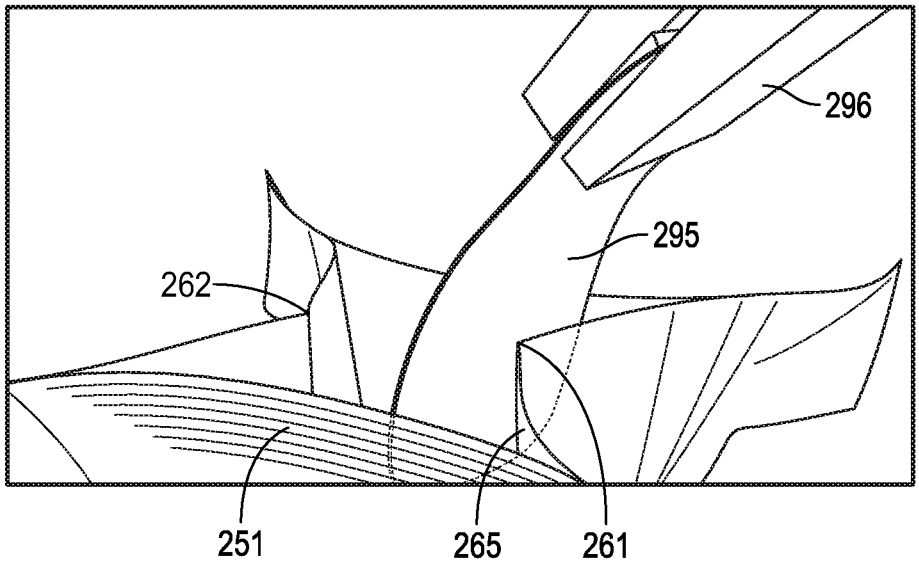
FIG. 20 is a perspective view of the gusset deflector of FIG. 19, the gusset deflector shown in the neck of the flexible container in a position to shield a gusset vertex of the neck prior to installation of a fitment in the neck.

In some preferred embodiments of the present invention, a gusset control method is deployed, as illustrated in FIGS. 19 and 20. The gusset control method prevents operational cycle stoppages related to the insertion of the fitment 270 into the neck 230. The primary principle of the gusset control method is to apply a controlled, deliberate force against at least one of the gusset vertices 261, 262 within the neck 230 prior to installation of fitment 270 in the neck 230. Absent the gusset control method, stoppages may occur when lowest edge 273 of fitment 270 intercepts at least one of the gusset vertices 261, 262 as the fitment 270 is lowered on the mandrel 280 into the expanded end 251 for positioning in the neck 230. When such an interception occurs, the intercepted vertex 261, 262 will move (i.e., be pushed) into the void defined by the expanded end 251, flare portion 250, and/or neck 230, thereby frustrating proper movement of the fitment 270 and mandrel 280 therethrough and preventing a suitable installation of the fitment 270 in the neck 230.

As shown in FIGS. 19 and 20, the gusset control method comprises deflector 295, which provides a force application that changes the shape and position of the gusset vertices 261, 262 within the neck 230 such that fitment 270 may be inserted and positioned in the neck 230 without the aforementioned interception. Ideally, the deflector 295 will move the gusset vertices 261, 262 into a position such that the expanded end 251 always comprises an operational circumference (i.e., prior to fitment 270 installation) that is greater than a circumference defined by the lowest edge 273 of the fitment 270.

In preferred embodiments of the gusset control method, the deflector 295 is held in place by a deflector clamp 296, which, like other aspects of the present invention, may be pneumatically powered and positioned by a rotary actuator. The deflector 295 may be a strip of material comprised of medium weight polytetrafluoroethene (PTFE). Functioning in a manner analogous to a shoehorn, the deflector 295 is preferably positioned against inner surface 265 of gusset vertex 261 to shield the lowest edge 273 of the fitment 270 from being intercepted by either of the gusset vertices 261, 262. For example, as the front and back face portions 222, 224 are held apart by clamps 221*a,b* as shown in FIG. 16, the deflector 295 is moved into position against preferably one of the two gusset vertices 261, 262 to shield the lowest edge 273 of the fitment 270 from interception by the vertex 261, 262 that is shielded by the deflector 295 as shown in FIG. 19. The unshielded vertex 261, 262 does not risk interception because the entire neck 230 position is biased as a result of the deflector 295 and thus the lowest edge 273 cannot reach the unshielded gusset vertex 261, 262 edge as fitment 270 is being moved toward the neck 230 during installation. Although the deflector 295 may be moved away from the shielded gusset vertex 261 or 262 during an interim step of the method described herein, the deflector may also remain in place until installation of fitment 270 in neck 230 is complete because the positioning of the deflector 295 and deflector clamp 296 does not interfere with other mechanical aspects of the installation.

Figure 21:
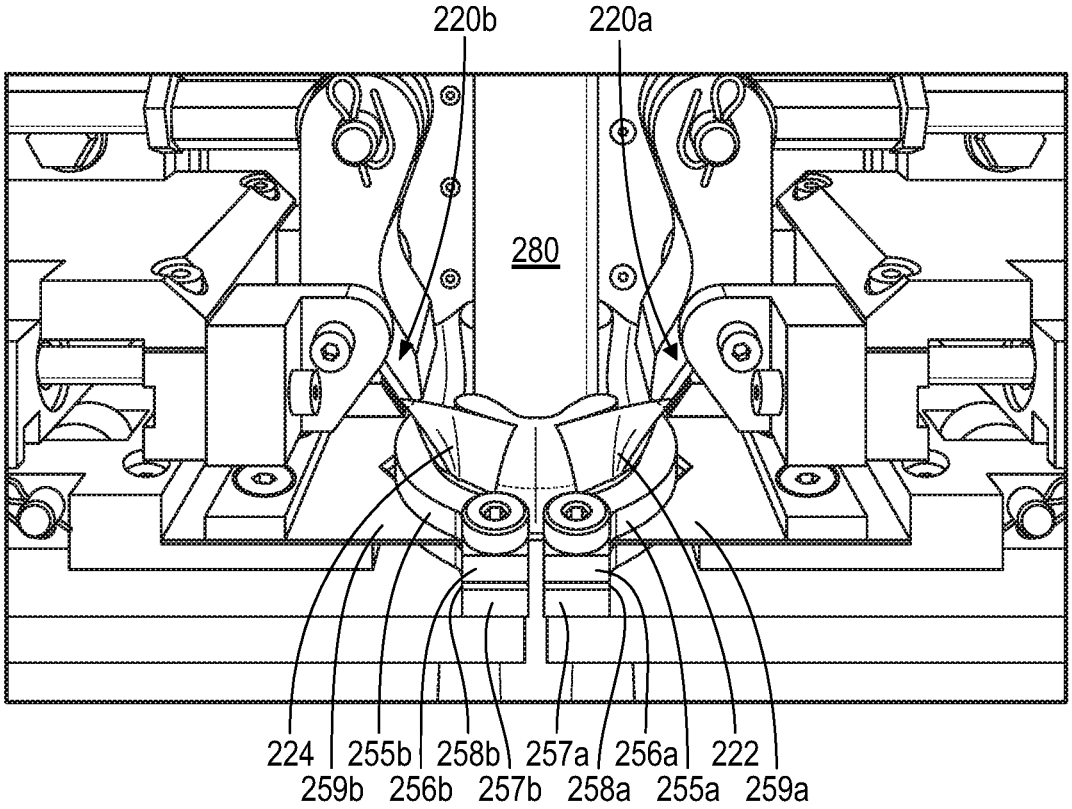
FIG. 21 is a perspective view of a flexible container in a collapsed configuration, wherein a mandrel has moved a fitment into a first position in the neck of the container, which is prepared for cutting by blades through knife slots formed by knife clamps, as provided in accordance with an embodiment of the present invention.

As shown in FIG. 21, knife clamps 255*a,b* close in on both of the front face portion 222 and back face portion 224 of the neck 230 and enclose the groove 286. Knife clamps 255*a,b* preferably comprise upper portions 256*a,b* and lower portions 257*a,b*, wherein the portions 256*a* and 257*a* define a slot 258*a* therebetween, and wherein portions 256*b* and 257*b* define a slot 258*b* therebetweeen. As shown, portions 256*a,b* and 257*a,b* not only secure the film of the neck 230 in place prior to cutting to prevent stretching of the film, the portions 256*a,b* and 257*a,b* also form upper and lower knife guides, such that the cutting blades 259*a,b* will pass through slots 258*a,b*, respectively as the blades 259*a,b* approach and retract from the groove 286 enclosed by clamps 250*a,b*. As noted, the knife clamps 255*a,b* hold the film of the neck 230 securely in place to prevent stretching or displacement of the film as it is being cut. When the knife clamps 255*a,b* are engaged with the mandrel 280, upper portions 256*a,b* preferably become indirectly connected to and substantially flush with guide ring 288 and lower portions 257*a,b* preferably become indirectly connected to and substantially flush with guide ring 289.

Figure 22:
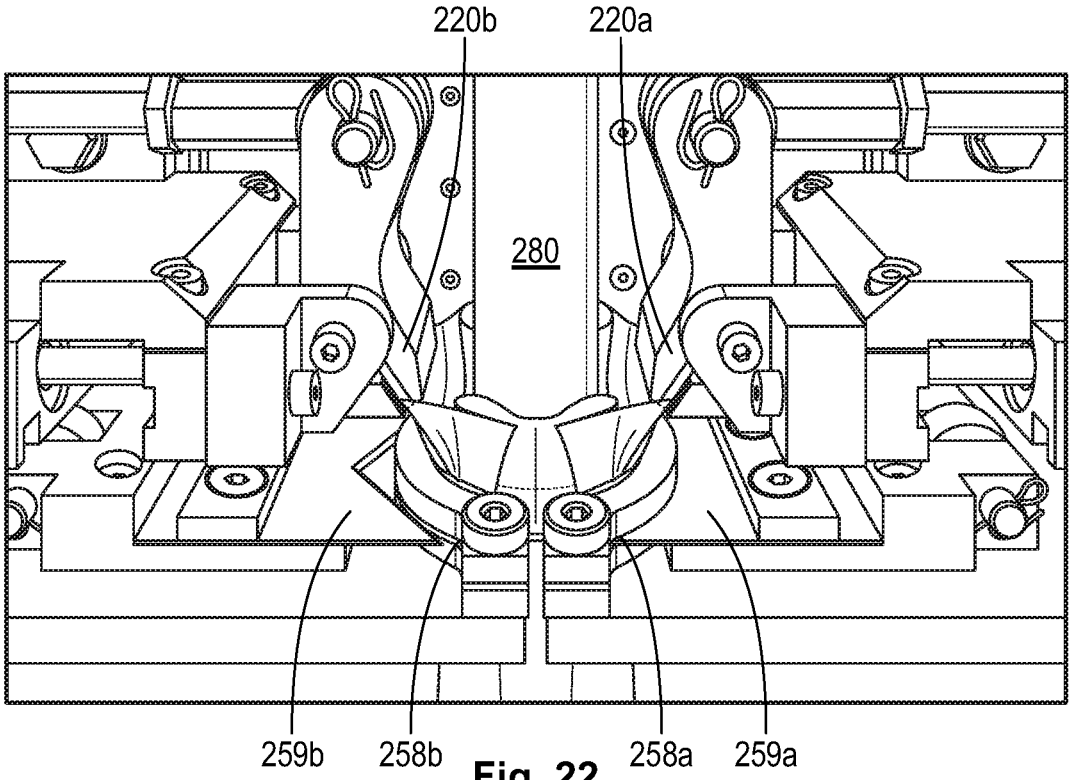
FIG. 22 is a perspective view of a flexible container in a collapsed configuration, as shown in FIG. 15, wherein the blades have been actuated for removal of an expanded portion of the neck, as provided in accordance with an embodiment of the present invention.

As shown in FIG. 22, preferably one cutting blade 259*a* will pass through the slot 258*a*, approach the neck 230, and cut a first portion of the neck 230 at the groove 286. Then, the opposite cutting blade 259*b* will pass through the slot 258*b*, approach the neck 230, and cut a second portion of the neck 230 at the groove 286 on the opposite side of the neck 230, such that the flared portion 250 is severed from the container 210 and temporarily retained by clamps 221*a,b*. In other words, the cutting blades 259*a,b* cut the neck 230 preferably in an alternating manner, as opposed to concurrently.

Figure 23:
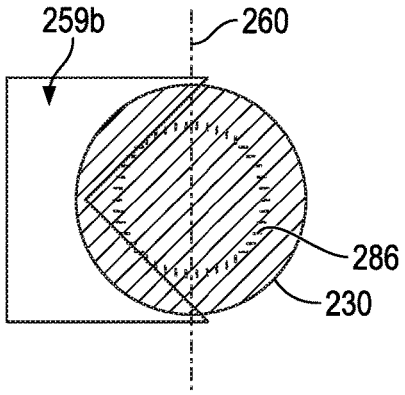
FIG. 23 is a cross-sectional diagram of a cutting blade passing through the film comprising the neck of a container to a groove of a mandrel, as provided in accordance with an embodiment of the present invention.
Figure 24:
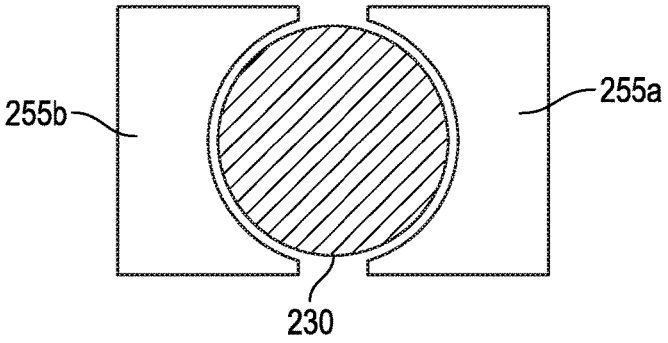
FIG. 24 is a cross-sectional diagram of knife clamps and the neck of a container provided in accordance with an embodiment of the present invention.

The cutting blades 259*a,b* are preferably V-shaped. FIG. 23 shows a diagram of a preferred orientation of cutting blades 259*a,b* relative to the neck 230. As shown, each cutting blade 259*a,b* will cut past a center line 260 of the neck 230 at the groove 286, which is preferable to obtain an overlapping (by about 10%) suitable cut of the neck 230 and also why the blades 259*a,b* operate in a serial/alternating manner so as not to interfere with each other. If you clamp the film first then run a knife around cutting into the grove can also work As shown in FIG. 24, it is also preferable for the mandrel 280 to have diameter that this substantially the same as the neck 230, such the clamps 255*a,b* can close in on the film of the neck 230 without wrinkling the film as might otherwise occur if the mandrel 280 diameter and the neck 230 diameter were not complementary in size.

Figure 25:
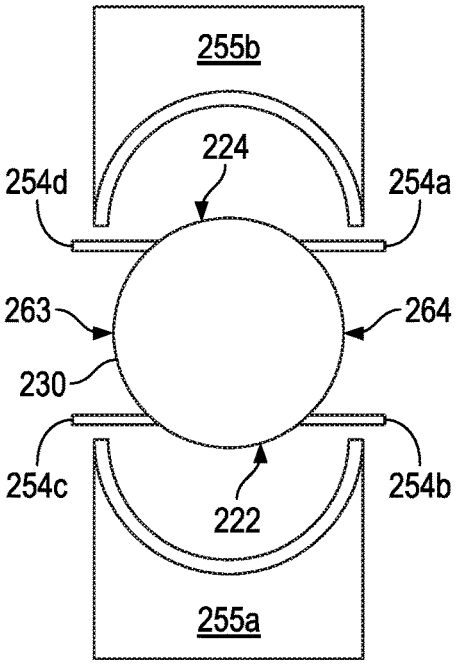
FIG. 25 is a cross-sectional diagram of cross-sectional diagram of knife clamps in a preferred approach toward flaps of the neck of a container provided in accordance with an embodiment of the present invention.
Figure 26:
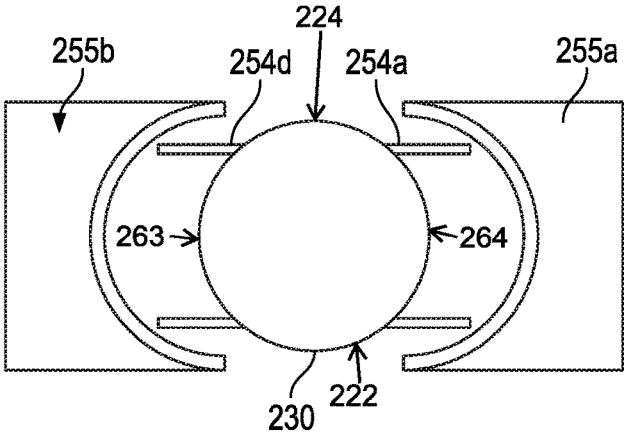
FIG. 26 is a cross-sectional diagram of cross-sectional diagram of knife clamps in a non-preferred approach toward flaps of the neck of a container provided in accordance with an embodiment of the present invention.

As shown in FIG. 25, an approach by knife clamps 255*a,b* from the front face portion 222 and the back face portion 224, respectively, of the neck 230 is preferred. It is preferred that the blades 259*a,b* cut the neck 230 in the direction in which the flaps 254*a,b,c,d* are to be folded when sealed against the neck 230. This is because such an approach will cause flaps 254*a,b,c,d* to lay against the gusseted sides 263, 264 of the neck 230, wherein a suitable seal of the flaps 254*a,b,c,d* against the neck 230 may be later formed because the flaps 254*a,b,c,d* will lay flat and unwrinkled against the neck 230. Flaps 254*a,b,c,d* are formed of peripheral seals 241 (analogously shown as seals 41 in FIGS. 1, 3, 4, and 5), in the neck 230. FIG. 26 shows a non-preferred approach of the knife clamps 255*a,b* wherein the flaps 254*a,b,c,d* would not lay flat against the neck 230 and tend to wrinkle because the flaps 254*a,b,c,d* will generally want to fold toward the gusseted sides 263, 264 and not toward the front face portion 222 and back face portion 224. Alternatively, under a non-preferred approach shown in FIG. 26, the flaps 254 a,b,c,d may tend to fold in an undesirable and sometimes random mix of orientations toward and away from the gusseted sides 263, 264. Alternatively, under a non-preferred approach as shown in FIG. 26 the flaps 254 a,b,c,d may remain approximately perpendicular to the portions 222, 224, 263, 264 of the neck 230 because the flaps 254 a,b,c,d tend to be relatively stiff in some embodiments of the container 210.

Figure 27:
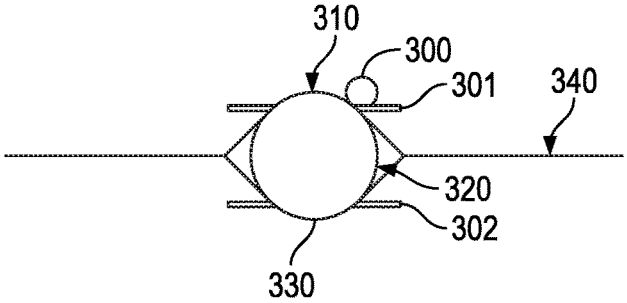
Fig. 27 (Prior Art)
FIG. 27 is a cross-sectional diagram of a prior art method of cutting away a portion of the neck of a flexible container using a scoring device that cuts the neck by rotational movement.

As further illustrated in the prior art diagram FIG. 27, when a rotary scoring device 300 engages flap 301 of neck 310 at a 2:00 position, the flap 301 may fold toward gusset side 320 as it is cut. However, when the scoring device 300 then engages flap 302 at a 4:00 position, the flap 302 will not want to fold flat toward back face 330 because the balance of the container 340 is pulling flaps 301 and 302 towards a 3:00 position. Accordingly, the flap 302 will bend and wrinkle as it is cut, thereby leaving a jagged edge of film at the neck 310 that makes a seal of a fitment into the neck 310 unreliable. In other words, jagged edges of the film that result from the aforementioned cuts of the prior art severely diminish the quality of the seal between the neck and the container, which can result in leaking of flowable contents from such prior art containers at the neck seal and/or catastrophic failure of such containers, particularly in the event of an impact.

This distinction over the prior art and advantage of containers of the present invention are also important for execution of a clean and suitable cut of the neck 230, particularly when the container 210 is comprised of thicker film and/or multiple layers of film as describe above in some embodiments. The thicker and/or the more layers of film that are present in the neck 230, and particularly in the flaps 254*a,b,c,d*, create a greater challenge to execute a clean and consistent cut at the neck 230 to remove the expanded end 251, particularly because the flaps 254*a,b,c,d* will become more and more stiff as they become thicker. More specifically, flaps 254*a,b,c,d* are preferably held down during cutting because they are relatively stiff at thicknesses greater than approximately 8 mils, and thus the flaps 254*a,b,c,d* will want to retain their position deflected away from (i.e., perpendicular to) the circumference of the neck 230. In that way, the flaps 254 a,b,c,d will tend to resist, wrinkle, and buckle when being cut, unless the knife clamp 255*a,b* approach and cutting method of the blades 259,*a,b* is utilized as defined herein. The jaggedness prior art cuts at the neck, particularly those formed using the rotational configuration shown in FIG. 27, has a dramatic detrimental effect on the reliability of the seal of such jagged neck portions to a base of a fitment. The present invention comprises a method of cleanly and reliably cutting the flaps 254 a,b,c,d and expanded end 251 from the neck 230, wherein the thickness of the flaps 254 a,b,c,d may be widely variable depending on the preferred embodiment of the container 210, and the cutting step is preferably performed at one station of the machine 202.

Figure 28:
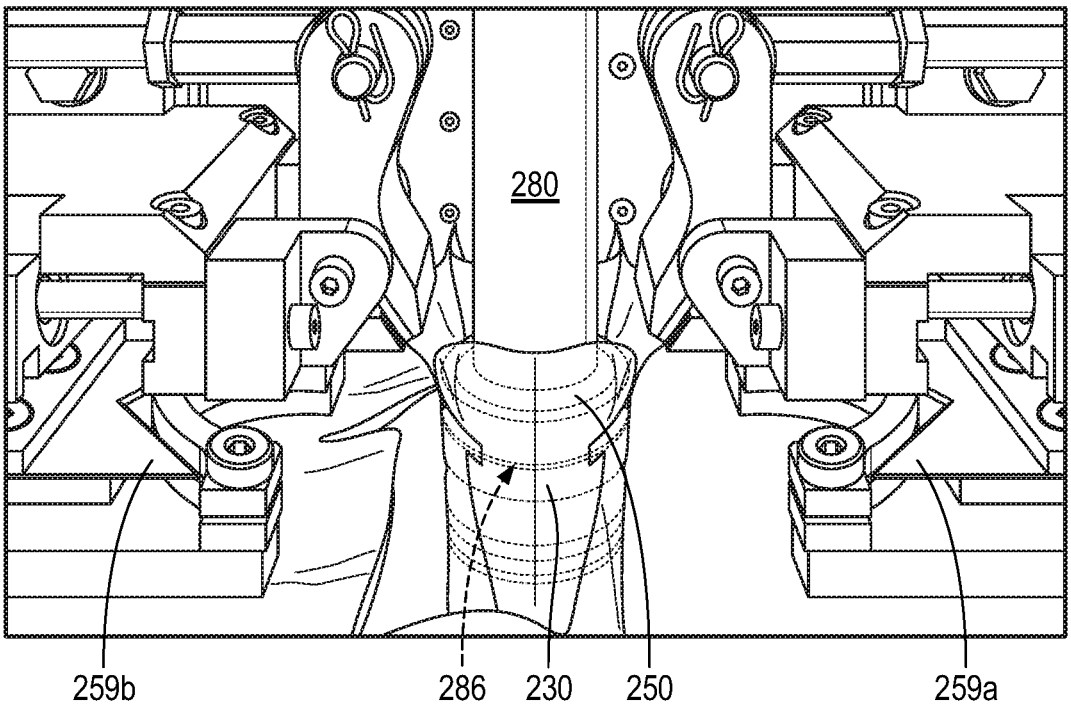
FIG. 28 is a perspective view of a flexible container in a collapsed configuration, wherein the blades and clamps shown in FIGS. 15 and 16 have retracted from the neck of the container.
Figure 29:
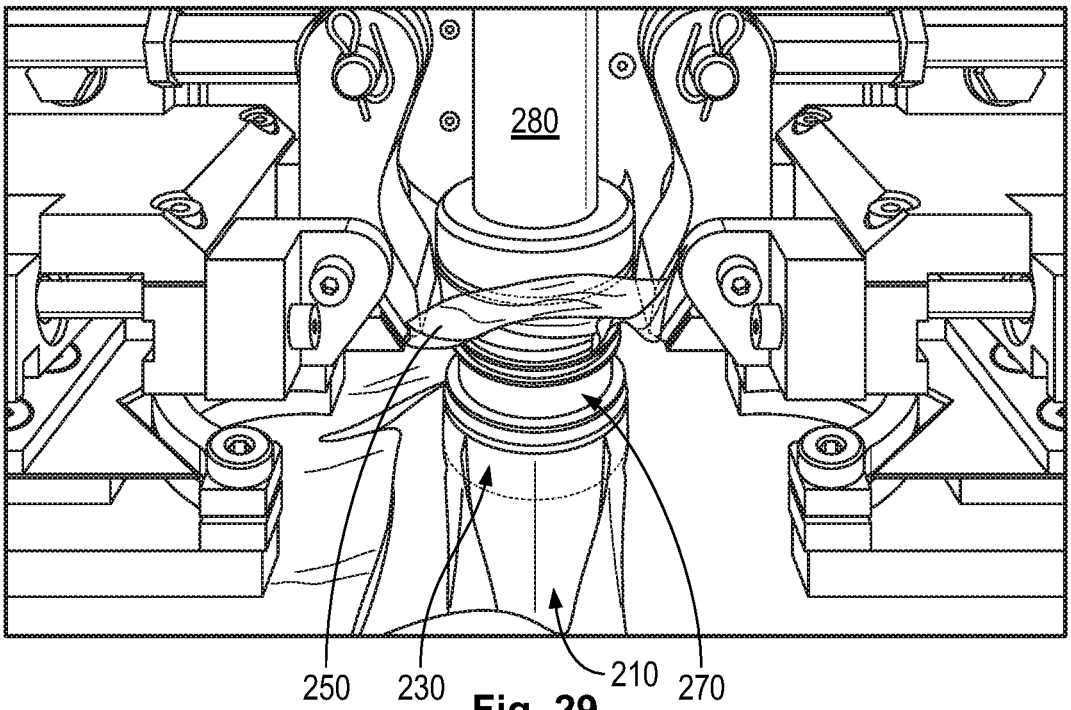
FIG. 29 is a perspective view of a flexible container in a collapsed configuration, wherein a mandrel has provided a fitment in a preferred position for sealing in the neck of the container, as provided in accordance with an embodiment of the present invention.

As shown in FIGS. 28 and 29, once the expanded end 251 is severed from the neck 230, the blades 259*a,b* and clamps 255*a,b* retract from the mandrel 280. Then, as shown in FIG. 29, the mandrel 280 will raise the fitment 270 to a second position in the neck 230 for sealing thereto.

Figure 30:
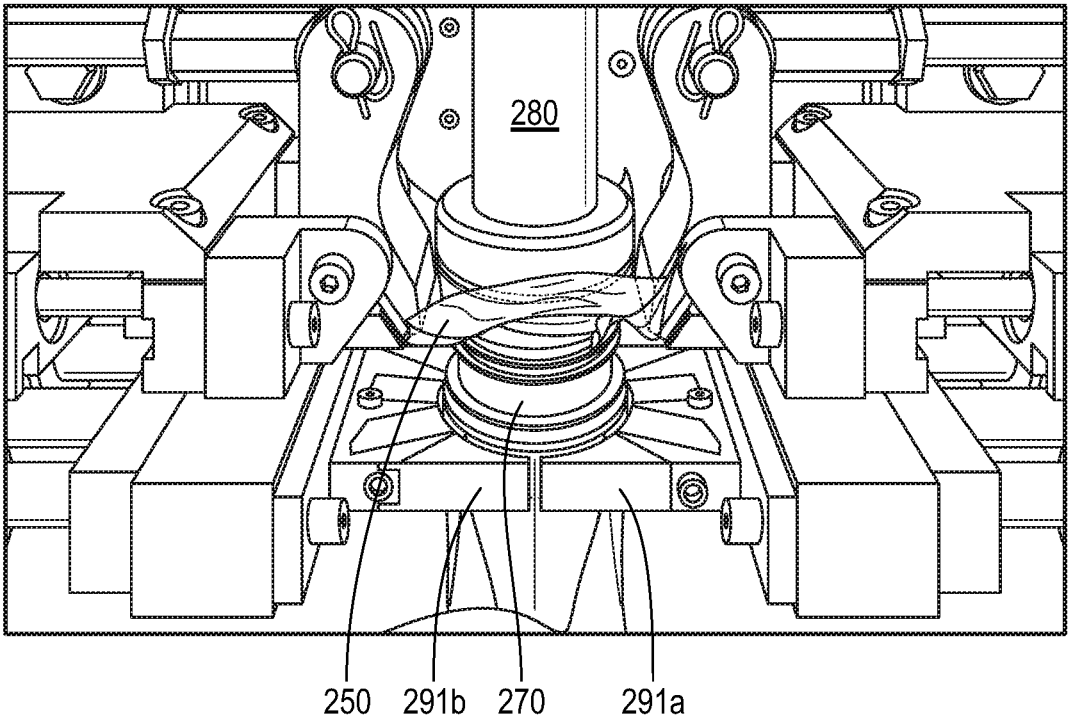
FIG. 30 is a perspective view of a flexible container in a collapsed configuration, wherein a fitment is sealed in the neck of the container, as provided in accordance with an embodiment of the present invention.

As shown in FIG. 30, sealing jaws 291*a,b* close around the neck 230 from the same front face portion 222 and back face portion 224 as did the blades 259*a,b* and clamps 255*a,b*. The sealing jaws 291 a,b preferably seal the flaps 254*a,b,c,d*, gusseted sides 263, 264, front face portion 222 and back face portion 224 to a base 272 of the fitment 270 preferably using heat and pressure. The flaps 254*a,b*, will fold toward and be sealed against gusseted side 264 and flaps 254*c,d* will fold toward and be sealed against gusseted side 263.

In some embodiments, the clamps 221*a,b* may release the cut away expanded end 251 and a vacuum may be used to dispose of the end 251 therefrom.

Figure 31:
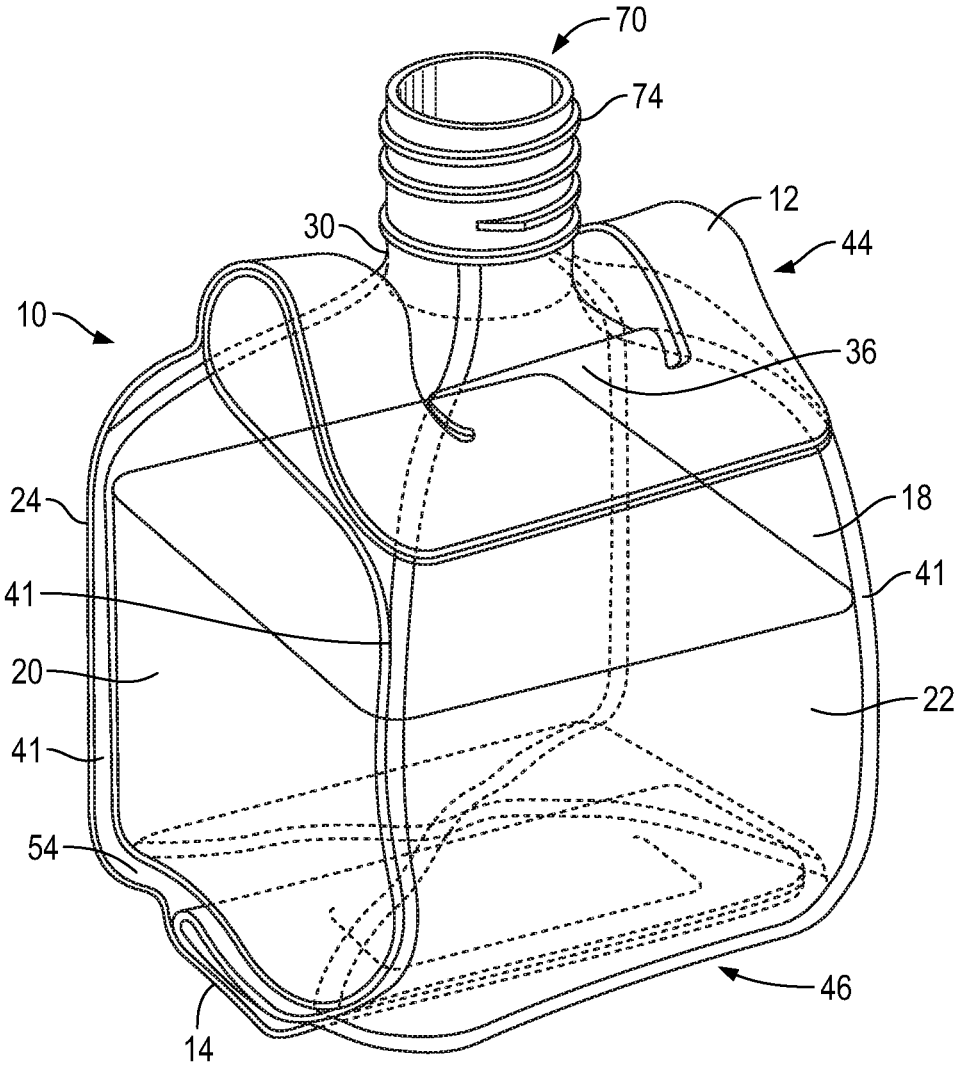
FIG. 31 is a perspective view of a flexible container in an expanded configuration with a fitment in accordance with an embodiment of the present disclosure.

FIG. 31 shows a preferred embodiment of an expanded container 10 (or container 210) having a fitment 70 (or 270) installed and formed in accordance with the present invention.

A machine for making sealed containers 10, 210 without fitments may be ganged together with the insert sealing machine 202 (to install the fitment 70, 270) and an optional filling machine (or other secondary process machine) to facilitate the formation and filling of containers 10, 210 of the present invention at high speed and efficiency, such that an automated production and filling line is utilized.

While embodiments in the present disclosure have been described in some detail, according to the preferred embodiments illustrated above, it is not meant to be limiting to modifications such as would be obvious to those skilled in the art.

The foregoing disclosure and description of the disclosure are illustrative and explanatory thereof, and various changes in the details of the illustrated apparatus and method may be made without departing from the spirit of the disclosure.

The invention claimed is:

1. A method for forming a flexible container, the method comprising the steps of:

(a) providing a collapsed flexible container formed from a flexible web material and comprising four panels, the panels comprising:
  (i) a body portion;
  (ii) a neck portion that extends from the body portion;
  (iii) a flare portion that extends from the neck portion;
  (iv) a tapered transition portion extending between the body portion and the neck portion;
  (v) a handle portion that extends from the body portion, the handle portion and the neck portion defining a handle opening therebetween; and
  (vi) wherein the neck portion has a reduced width, the flare portion has an expanded end, and a width of the flare portion increases from the neck portion to the expanded end of the flare portion;

(b) moving apart a front face portion and a back face portion of the flare portion;

(c) gripping the front face portion and the back face portion of the flare portion between one or more holding clamps;

(d) providing a fitment on a mandrel, wherein the mandrel comprises one or more guide rings that define a groove;

(e) inserting the fitment via the mandrel through the expanded end of the flare portion and into the neck portion, wherein the fitment is provided in a first position in the neck portion of the flexible container;

(f) clamping the web material comprising the neck portion to prevent stretching of the material via one or more knife clamps that extend toward the mandrel and secure the web material comprising the neck portion between a surface of the one or more knife clamps and a surface of the one or more guide rings, wherein the one or more knife clamps defines a slot;

(g) transversely cutting the web material at the neck portion via extending one or more cutting blades through the slot defined by the one or more knife clamps and into the groove defined by the one or more guide rings, thereby nonrotationally severing the flare portion from the neck portion of the container to provide a severed flare portion;

(h) moving the fitment to a second position in the neck portion of the flexible container;

(i) sealing a remaining portion of the web material comprising the neck portion to the fitment.

2. The method of claim 1, the handle portion further comprising one or more handle legs and the flare portion further comprising one or more tabs, wherein the one or more tabs directly connect the flare portion to the one or more handle legs at one or more connected portions.

3. The method of claim 2, further comprising the following step between steps (a) and (b):

($a_1$) severing the one or more of the connected portions.

4. The method of claim 3, wherein step ($a_1$) is performed by moving the handle portion away from the flare portion such that the connected portions are severed.

5. The method of claim 2, further comprising the following steps between steps (a) and (b):

($a_1$) forming a continuous roll of the flexible containers in a collapsed configuration, wherein consecutive containers are temporarily connected by a connection at top and bottom edges of a common periphery;

($a_2$) feeding the continuous roll of the flexible containers into an insert sealing machine configured to carry out steps (b) through (i);

($a_3$) severing the connection at the top and bottom edges of the common periphery between two consecutive flexible containers and severing the one or more connected portions between the flare portion and the one or more handle legs; and ($a_4$) moving apart the front face portion and the back face portion of the flare portion to a first position using suction cups, wherein the moving apart of the front face portion and the back face portion in step (c) is to a second position.

6. The method of claim 5, further comprising the steps of:

(A) ganging together a container machine for the formation of the continuous roll of flexible containers, an unwinding stand for housing the continuous roll, an insert sealing machine for installation of a fitment into each individual flexible container, and a filling machine;

(B) feeding an end of the continuous roll of flexible containers in a collapsed configuration into the insert sealing machine;

(C) moving the flexible containers having the fitment installed therein into the filling machine wherein the flexible containers are filled with a flowable material dispensed from the filling machine, thereby providing the flexible containers in an expanded configuration; and (D) using a packaging machine to package the flexible containers in an expanded configuration.

7. The method of claim 1, wherein the one or more knife clamps further comprises an upper portion and a lower portion, the upper portion and the lower portion defining the slot therethrough.

8. The method of claim 7, wherein the surface of the one or more knife clamps and the surface of the one or more guide rings have complementary shapes.

9. The method of claim 1, wherein the one or more cutting blades are V-shaped at a cutting edge thereof.

10. The method of claim 1, wherein the one or more cutting blades of step (g) extends past a diameter of the neck portion that is perpendicular to a transverse direction of the one or more cutting blades.

11. The method of claim 1, wherein the neck portion further comprises first and second gusset sides, and a plurality of flaps, and wherein at clamping step (f) the one or more knife clamps fold and secure at least two of the flaps against the first gusset side and at least two of the flaps against the second gusset side, the knife clamps thereby substantially enclosing a portion of the neck portion.

12. The method of claim 11, wherein the mandrel comprises a diameter that is approximately the same as a diameter of the neck portion, such that a friction fit may be formed between the mandrel and the neck portion at step (e), thereby obviating wrinkling of the web material comprising the neck portion when the one or more knife clamps enclose the portion of the neck portion.

13. The method of claim 1, further comprising steps:

(j) releasing the severed flare portion from the one or more holding clamps; and (k) using a vacuum to remove the released severed flare portion from the insert sealing machine.

14. The method of claim 13, wherein the method is fully automated.

15. The method of claim 1, wherein the method is fully automated.

16. The method of claim 1, wherein the flare portion further comprises opposing first and second gusset vertices, and further comprising the following step between steps (b) and (e): providing a deflector at an inner surface of the first gusset vertex.

17. The method of claim 1, wherein at least one of the one or more holding clamps comprises opposing portions configured to pinch and hold the front face portion or the back face portion between the opposing portions.

18. The method of claim 1, wherein the one or more cutting blades are two laterally opposing cutting blades.

* * * * *